US005766372A

United States Patent [19]

Fujimura et al.

[11] Patent Number: 5,766,372

[45] Date of Patent: Jun. 16, 1998

[54] METHOD OF MAKING MAGNETIC PRECURSOR FOR PERMANENT MAGNETS

[75] Inventors: Setsuo Fujimura, Kyoto; Yutaka Matsuura, Hyogo-ken; Masato Sagawa, Kyoto, all of Japan

[73] Assignee: Sumitomo Special Metals Co., Ltd., Osaka, Japan

[21] Appl. No.: 848,283

[22] Filed: Apr. 29, 1997

Related U.S. Application Data

[62] Division of Ser. No. 485,183, Jun. 7, 1995, Pat. No. 5,645,651, which is a division of Ser. No. 194,647, Feb. 10, 1994, Pat. No. 5,466,308, which is a continuation of Ser. No. 105,886, Feb. 10, 1993, abandoned, which is a continuation of Ser. No. 794,673, Nov. 18, 1991, abandoned, which is a continuation of Ser. No. 286,637, Dec. 19, 1988, abandoned, which is a division of Ser. No. 516,841, Jul. 25, 1983, Pat. No. 4,792,368, and a continuation-in-part of Ser. No. 224,411, Jul. 26, 1988, Pat. No. 5,096,512, which is a division of Ser. No. 13,165, Feb. 10, 1987, Pat. No. 4,770,723, which is a continuation of Ser. No. 510,234, Jul. 1, 1984, abandoned.

[30] Foreign Application Priority Data

| | | | |
|---|---|---|---|
| Aug. 21, 1982 | [JP] | Japan | 57-145070 |
| Sep. 27, 1982 | [JP] | Japan | 57-166663 |
| Nov. 15, 1982 | [JP] | Japan | 57-200204 |
| Jan. 19, 1983 | [JP] | Japan | 58-5813 |
| Jan. 19, 1983 | [JP] | Japan | 58-5814 |
| Mar. 8, 1983 | [JP] | Japan | 58-37896 |
| Mar. 8, 1983 | [JP] | Japan | 58-37897 |
| Mar. 8, 1983 | [JP] | Japan | 58-37898 |
| Mar. 8, 1983 | [JP] | Japan | 58-37899 |
| May 14, 1983 | [JP] | Japan | 58-84858 |
| May 14, 1983 | [JP] | Japan | 58-84859 |
| May 14, 1983 | [JP] | Japan | 58-84860 |
| May 31, 1983 | [JP] | Japan | 58-94876 |

[51] Int. Cl.[6] ..... C02C 38/00

[52] U.S. Cl. ..... 148/101; 148/302

[58] Field of Search ..... 148/302, 101; 420/121, 83

[56] References Cited

U.S. PATENT DOCUMENTS

| | | | |
|---|---|---|---|
| 4,601,875 | 7/1986 | Yamamoto et al. | 148/302 |
| 4,684,400 | 8/1987 | Matsuura et al. | 148/302 |
| 4,767,474 | 8/1988 | Fujimura et al. | 148/302 |
| 4,770,723 | 9/1988 | Sagawa et al. | 420/121 |
| 4,773,950 | 9/1988 | Fujimura et al. | 420/121 |
| 4,792,368 | 12/1988 | Sagawa et al. | 148/302 |
| 4,840,684 | 6/1989 | Fujimura et al. | 148/302 |

FOREIGN PATENT DOCUMENTS

| | | |
|---|---|---|
| 57-145072 | 8/1982 | Japan . |
| 57-166663 | 9/1982 | Japan . |
| 57-200204 | 11/1982 | Japan . |
| 58-5813 | 1/1983 | Japan . |
| 58-5814 | 1/1983 | Japan . |
| 58-37896 | 3/1983 | Japan . |
| 58-37897 | 3/1983 | Japan . |
| 58-37898 | 3/1983 | Japan . |
| 58-37899 | 3/1983 | Japan . |
| 58-84858 | 5/1983 | Japan . |

OTHER PUBLICATIONS

Kuzma, Yu B., "The Interaction of Transistion and Rare Earth Metal With Boron", Journal of the Less Common Metals, 67(1979), pp. 51–57.

*Primary Examiner*—Deborah Yee
*Attorney, Agent, or Firm*—Morrison & Foerster

[57] ABSTRACT

Magnetic materials comprising Fe, B, R (rare earth elements) and Co having a major phase of Fe—CO—B—R intermetallic compound(s) of tetragonal system, and sintered anisotropic permanent magnets consisting essentially of, by atomic percent, 8–30% R (at least one of rare earth elements inclusive of Y), 2–28% B, no less than 50% Co, and the balance being Fe with impurities. Those may contain additional elements M (Ti, Ni, Bi, V, Nb, Ta, Cr, Mo, W, Mn, Al, Sb, Ge, Sn, Zr, Hf) providing Fe—Co—B—R—M type materials and magnets.

24 Claims, 16 Drawing Sheets

57Fe - 20Co - 8B - 15Nd

METHOD OF MAKING MAGNETIC PRECURSOR FOR PERMANENT MAGNETS

This application is a division of application Ser. No. 08/485,183, filed Jun. 7, 1995, now U.S. Pat. No. 5,645,651, which was a division of application Ser. No. 08/194,647, filed Feb. 10, 1994, now U.S. Pat. No. 5,466,308, which was a continuation of application Ser. No. 08/105,886, filed Feb. 10, 1993, now abandoned, which was a continuation of application Ser. No. 07/794,673, filed Nov. 18, 1991, now abandoned, which was a continuation of application Ser. No. 07/286,637, filed Dec. 19, 1988, now abandoned, which was a division of application Ser. No. 06/516,841, filed Jul. 25, 1983, now U.S. Pat. No. 4,792,368, and a continuation-in-part of Ser. No. 07/224,411, filed Jul. 26, 1988, now U.S. Pat. No. 5,096,512, which was a division of application Ser. No. 07/013,165, filed Feb. 10, 1987, now U.S. Pat. No. 4,770,723, which was a continuation of application Ser. No. 06/510,234, filed Jul. 1, 1984, now abandoned.

FIELD OF THE INVENTION

The present invention relates to improvements in the temperature dependency of the magnetic properties of magnetic materials and permanent magnets based on Fe—B—R systems. In the present disclosure, R denotes rare earth element inclusive of yttrium.

BACKGROUND OF THE INVENTION

Magnetic materials and permanent magnet materials are one of the important electric and electronic materials applied in an extensive range from various electrical appliances for domestic use to peripheral terminal devices of large-scaled computers. In view of recent needs for miniaturization and high efficienty of electric and electronic equipments, there has been an increasing demand for upgrading of permanent magnet materials and generally magnetic materials.

The permanent magnet materials developed yet include alnico, hard ferrite and samarium-cobalt (SmCo) base materials which are well-known and used in the art. Among these, alnico has a high residual magnetic flux density (hereinafter referred to Br) but a low coercive force (hereinafter referred to Hc), whereas hard ferrite has high Hc but low Br.

Advance in electronics has caused high integration and miniaturization of electric components. However, the magnetic circuits incorporated therein with alnico or hard ferrite increase inevitably in weight and volume, compared with other components. On the contrary, the SmCo base magnets meet a demand for miniaturization and high efficiency of electric circuits due to their high Br and Hc. However, samarium is rare natural resource, while cobalt should be included 50–60 wt % therein, and is also distributed at limited areas so that its supply is unstable.

Thus, it is desired to develop novel permanent magnet materials free from these drawbacks.

If it could be possible to use, as the main component for the rare earth elements use be made of light rare earth elements that occur abundantly in ores without employing much cobalt, the rare earth magnets could be used abundantly and with less expense in a wider range. In an effort made to obtain such permanent magnet materials, R—$Fe_2$ base compounds, wherein R is at least one of rare earth metals, have been investigated. A. E. Clark has discovered that sputtered amorphous TbFe2 has an energy product of 29.5 MGOe at 4.2° K., and shows a coercive force Hc=3.4 kOe and a maximum energy product (BH)max=7 MGOe at room temperature upon heat-treated at 300°–500° C.

Reportedly, similar investigations on $Sm_2Fe_2$ indicated that 9.2 MGOe was reached at 77° K. However, these materials are all obtained by sputtering in the form of thin films that cannot be generally used as magnets, e.g., speakers or motors. It has further been reported that melt-quenched ribbons of PrFe base alloys show a coercive force Hc of as high as 2.8 kOe.

In addition, Koon et al discovered that, with melt-quenched amorphous ribbons of $(Fe_{0.82}B_{0.18})_{0.9}Tb_{0.05}La_{0.05}$, Hc of 9 kOe was reached upon annealed at 627° C. (Br=5 kG). However, (BH)max is then low due to the unsatisfactory loop squareness of magnetization curves (N. C. Koon et al, Appl. Phys. Lett. 39 (10), 1981, pp. 840–842).

Moreover, L. Kabacoff et al reported that among melt-quenched ribbons of $(Fe_{0.8}B_{0.2})_{1-x}Pr_x$ (x=0–0.03 atomic ratio), certain ones of the Fe—Pr binary system show Hc on the kilo oersted order at room temperature.

These melt-quenched ribbons or sputtered thin films are not any practical permanent magnets (bodies) that can be used as such. It would be practically impossible to obtain practical permanent magnets from these ribbons or thin films.

That is to say, no bulk permanent magnet bodies of any desired shape and size are obtainable from the conventional Fe—B—R base melt-quenched ribbons or R—Fe base sputtered thin films. Due to the unsatisfactory loop squareness (or rectangularity) of the demagnetization curves, the Fe—B—R base ribbons heretofore reported are not taken as the practical permanent magnet materials comparable with the conventional, ordinary magnets. Since both the sputtered thin films and the melt-quenched ribbons are magnetically isotropic by nature, it is indeed almost impossible to obtain therefrom magnetically anisotropic (hereinbelow referred to "anisotropic") permanent magnets for the practical purpose comparable to the conventional hard ferrite or SmCo magnets.

SUMMARY OF THE DISCLOSURE

An essential object of the present invention is to provide novel magnetic materials and permanent magnets based on the fundamental composition of Fe—B—R having an improved temperature dependency of the magnetic properties.

Another object of the present invention is to provide novel practical permanent magnets and magnetic materials which do not share any disadvantages of the prior art magnetic materials hereinabove mentioned.

A further object of the present invention is to provide novel magnetic materials and permanent magnets having good temperature dependency and magnetic properties at room or elevated temperatures.

A still further object of the present invention is to provide novel magnetic materials and permanent magnets which can be formed into any desired shape and practical size.

A still further object of the present invention is to provide novel permanent magnets having magnetic anisotropy and excelling in both magnetic properties and mechanical strength.

A still further object of the present invention is to provide novel magnetic materials and permanent magnets in which as R use can effectively be made of rare earth element occurring abundantly in nature.

Other objects of the present invention will become apparent from the entire disclosure given herein.

The magnetic materials and permanent magnets according to the present invention are essentially formed of alloys comprising novel intermetallic compounds, and are crystalline, said intermetallic compounds being characterized at least by new Curie points Tc.

In the followings the term "percent" or "%" denotes the atomic percent (abridged as "at %") if not otherwise specified.

According to the first aspect of the present invention, there is provided a magnetic material comprising Fe, B, R (at least one of rare earth element including Y) and Co, and having its major phase formed of Fe—Cc—B—R type compound that is of the substantially tetragonal system crystal structure.

According to the second aspect of the present invention there is provided a sintered magnetic material having its having its major phase formed of a compound consisting essentially of, in atomic ratio, 8 to 30% of R (wherein R represents at least one of rare earth element including Y), 2 to 28% of B, no more than 50% of Co (except that the amount of Co is zero) and the balance being Fe and impurities.

According to the third aspect of the present invention, there is provided a sintered magnetic material having a composition similar to that of the aforesaid sintered magnetic material, wherein the major phase is formed of an Fe—Co—B—R type compound that is of the substantially tetragonal system.

According to the fourth aspect of the present invention, there is provided a sintered permanent magnet (an Fe—Co—B—R base permanent magnet) consisting essentially of, in atomic ratio, 8 to 30% of R (at least one of rare earth element including Y), 2 to 28% of B, no more than 50% of Co (except that the amount of Co is zero) and the balance being Fe and impurities. This magnet is anisotropic.

According to the fifth aspect of the present invention, there is provided a sintered anisotropic permanent magnet having a composition similar to that of the fourth permanent magnet, wherein the major phase is formed by an Fe—Co—B—R type compound that is of the substantially tetragonal system crystal structure.

Fe—Co—R base magnetic materials according to the 6th to 8th aspects of the present invention are obtained by adding to the first–third magnetic materials the following additional elements M, provided, however, that the additional elements M shall individually be added in amounts less than the values as specified below, and that, when two or more elements M are added, the total amount thereof shall be less than the upper limit of the element that is the largest, among the elements actually added (For instance, Ti, V and Nb are added, the sum of these must be no more than 12.5% in all.):

| | | |
|---|---|---|
| 4.5% Ti, | 8.0% Ni, | 5.0% Bi, |
| 9.5% V, | 12.5% Nb, | 10.5% Ta, |
| 8.5% Cr, | 9.5% Mo, | 9.5% W, |
| 8.0% Mn, | 9.5% Al, | 2.5% Sb, |
| 7.0% Ge, | 3.5% Sn, | 5.5% Zr, |
| and 5.5% Hf. | | |

Fe—B—R—Co base permanent magnets according to the 9th to and 10th aspects of the present invention are obtained by adding respectively to the 4th and 5th permanent magnets the aforesaid additional elements M on the same condition.

Due to the inclusion of Co, the invented magnetic materials and permanent magnets have a Curie point higher than that of the Fe—B—R type system or the Fe—B—R—M type system.

With the permanent magnets of the present invention, practically useful magnetic properties are obtained if the mean crystal grain size of the intermetallic compound is in a range of about 1 to about 100 μm for both the Fe—Co—B—R and Fe—Co—B—R—M systems.

Furthermore, the inventive permanent magnets can exhibit good magnetic properties by containing 1 vol. % or higher of nonmagnetic intermetallic compound phases.

The inventive magnetic materials are advantageous in that they can be obtained in the form of at least as-cast alloys, or powdery or granular alloys or sintered bodies in any desired shapes, and applied to magnetic recording media (such as magnetic recording tapes) as well as magnetic paints, magnetostrictive materials, thermosensitive materials and the like. Besides, the magnetic materials are useful as the intermediaries for the production of permanent magnets.

The magnetic materials and permanent magnets according to the present invention are superior in mechanical strength and machinability to the prior art alnico, R—Co type magnets, ferrite, etc., and has high resistance against chipping-off on machining.

In the following the present invention will be elucidated with reference to the accompanying Drawings which, however, are being presented for illustrative purpose.

DETAILED DESCRIPTION OF THE PREFERRED EMBODIMENTS

Figure 1:
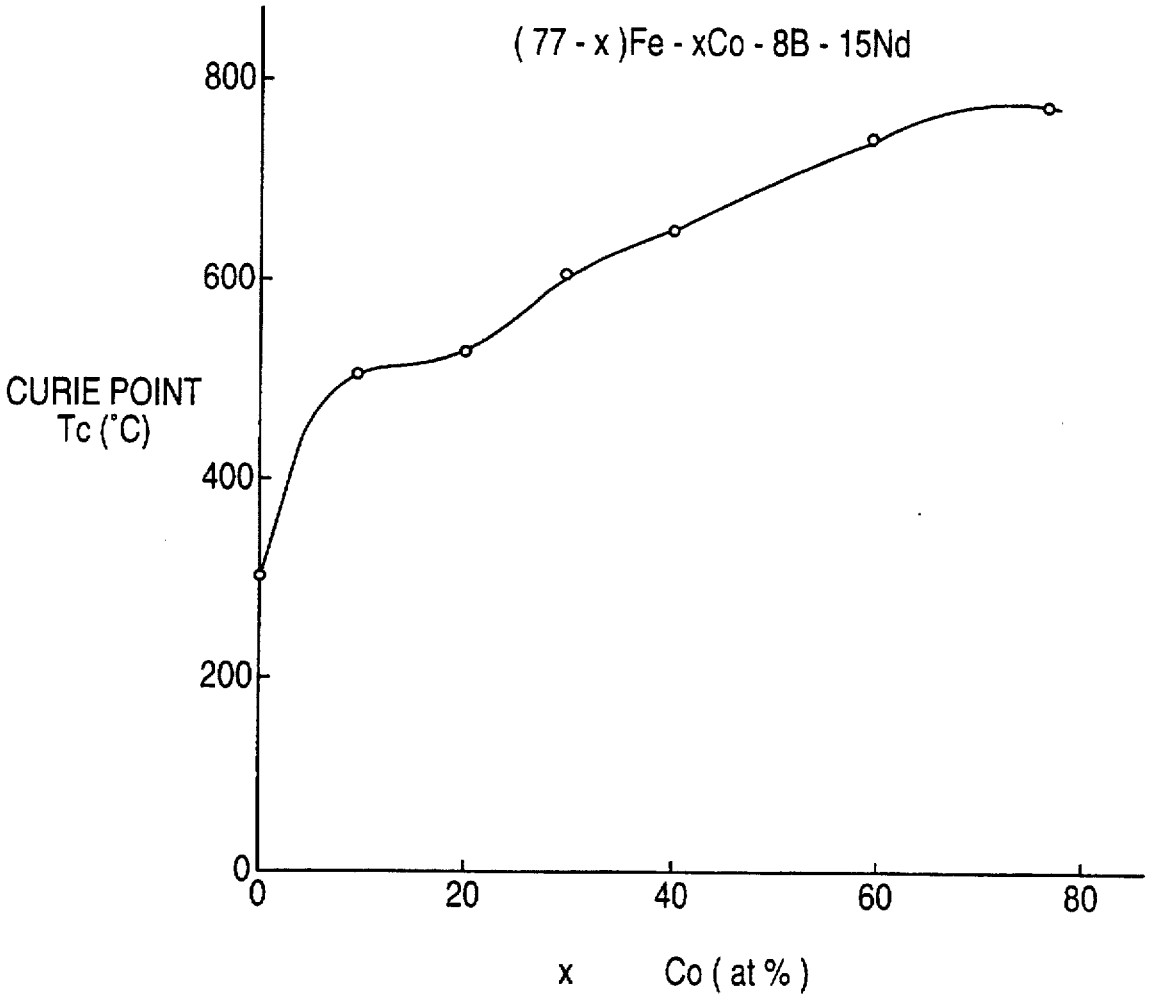
FIG. 1 is a graph showing relationship between the Curie point and the amount of Co of one embodiment of the present invention, with the atomic percent of Co as abscissa.

The present inventors have found magnetic materials and permanent magnets of the Fe—B—R system the magnets comprised of magnetically anisotropic sintered bodies to be new high-performance permanent magnets without employing expensive Sm and Co, and disclosed them in a U.S. patent application Ser. No. 510,234 filed on Jul. 1, 1983 based on a Japanese Patent Application No. 57-145072. The Fe—B—R base permanent magnets contain Fe as the main component and light-rare earth elements as R, primarily Nd and Pr, which occur abundantly in nature, and contain no Co. Nonetheless, they are excellent in that they can show an energy product reaching as high as 25–35 MGOe or higher. The Fe—B—R base permanent magnets possess high characteristics at costs lower than required in the case with the conventional alnico and rare earth-cobalt alloys. That is to say, they offer higher cost-performance and, hence, greater advantages as they stand.

As disclosed in the above application, the Fe—B—R base permanent magnets have a Curie point of generally about 300° C. and at most 370° C. The entire disclosure of said application is herewith incorporated herein with reference thereto with respect to the Fe—B—R type magnets and magnetic materials Such a Curie point considerably low, compared with the Curie points amounting to about 800° C. of the prior art alnico or R—Co base permanent magnets. Thus, the Fe—B—R base permanent magnets have their magnetic properties more dependent upon temperature, as compared with the alnico or R—Co base magnets, and are prone to deteriorate magnetically when used at elevated temperatures.

As mentioned above, the present invention has for its principal object to improve the temperature dependency of the magnetic properties of the Fe—B—R base magnets and generally magnetic materials. According to the present invention, this object is achieved by substituting part of Fe, a main component of the Fe—B—R base magnets, with Co so as to increase the Curie point of the resulting alloy. The results of researches have revealed that the Fe—B—R base magnets are suitably used in a usual range of not higher than 70° C., since the magnetic properties deteriorate at temperature higher than about 100° C. As A result of various experiments and studies, it has thus been found that the substitution of Co for Fe is effective for improving the resistance to the temperature dependency of the Fe—B—R base permanent magnets and magnetic materials.

More specifically, the present invention provides permanent magnets comprised of anisotropic sintered bodies consisting essentially of, in atomic percent, 8 to 30% R (representing at least one of rare earth element including yttrium), 2 to 28% of B and the balance being Fe and inevitable impurities in which part of Fe is substituted With Co to incorporate 50 at % or less of Co in the alloy compositions, whereby the temperature dependency of said permanent magnets are substantially increased to an extent comparable to those of the prior art alnico and R—Co base alloys.

According to the present invention, the presence of Co does not only improve the temperature dependency of the Fe—B—R base permanent magnets, but also offer additional advantages. That is to say, it is possible to attain high magnetic properties through the use of light-rare earth elements such as Nd and Pr which occur abundantly in nature. Thus, the present Co-substituted Fe—B—R base magnets are superior to the existing R—Co base magnets from the standpoints of both natural resource and cost as well as magnetic properties.

It has further been revealed from extensive experiments that the resistance to the temperature dependency and the magnetic properties best-suited for permanent magnets are attained in the case where part of Fe is replaced by Co, the crystal structure is substantially of the tetragonal system, and the mean crystal grain size of the sintered body having a substantially tetragonal system crystal structure is in a certain range. Thus, the present invention makes it possible to ensure industrial production of high-performance sintered permanent magnets bases on the Fe—Co—B—R system in a stable manner.

By measurements, it has been found that the Fe—Co—B—R base alloys have a high crystal magnetic anistropy constant Ku and an anisotropic magnetic field Ha standing comparison with that of the existing Sm—Co base magnets.

According to the theory of the single domain particles, magnetic substances having high anisotropy field Ha potentially provide fine particle type magnets with high-performance as is the case with the hard ferrite or SmCo base magnets. From such a viewpoint, sintered, fine particle taupe magnets were prepared with wide ranges of composition and varied crystal grain size after sintering to determine the permanent magnet properties thereof.

As a consequence, it has been found that the obtained magnet properties correlate closely with the mean crystal grain size after sintering. In general, the single magnetic domain, fine particle type magnets magnetic walls which are formed within each particles, if the particles are large. For this reason, inversion of magnetization easily takes place due to shifting of the magnetic walls, resulting in a low Hc. On the contrary, if the particles are reduced in size to below a certain value, no magnetic walls are formed within the particles. For this reason, the inversion of magnetization proceeds only by rotation, resulting in high Hc. The critical size defining the single magnetic domain varies depending upon diverse materials, and has been thought to be about 0.01 μm for iron, about 1 μm for hard ferrite; and about 4 μm for SmCo.

The Hc of various materials increases around their critical size. In the Fe—Co—B—R base permanent magnets of the present invention, Hc of 1 kOe or higher is obtained when the mean crystal grain size ranges from 1 to 100 μm, while Hc of 4 kOe or higher is obtained in a range of 1.5 to 50 μm.

The permanent magnets according to the present invention are obtained as sintered bodies. Thus, the crystal grain size of the sintered body after sintering is of the primary concern. It has experimentally been ascertained that, in order to allow the Hc of the sintered compact to exceed 1 kOe, the mean crystal grain size should be no less than about 1 μm after sintering. In order to obtain sintered bodies having a smaller crystal grain size than this, still finer powders should be prepared prior to sintering. However, it is then believed that the Hc of the sintered bodies decrease considerably, since the fine powders of the Fe—Co—B—R alloys are susceptible to oxidation, the influence of distortion applied upon the fine particles increases, superparamagnetic substances rather than ferromagnetic substances are obtained when the grain size is excessively reduced, or the like. When the crystal grain size exceeds 100 μm, the obtained particles are not single magnetic domain particles, and include magnetic walls therein, so that the inversion of magnetization easily takes place, thus leading to a drop in Hc. A grain size of no more than 100 μm is required to obtain Hc of no less than 1 kOe. Particular preference is given to a range of 1.5 to 50 μm, within which Hc of 4 kOe or higher is attained.

It should be noted that the Fe—Co—B—R—M base allows to be discussed later also exhibit the magnetic properties useful for permanent magnets, when the mean crystal grain size is between about 1 and about 100 μm, preferably 1.5 and 50 μm.

It is generally observed that, as the amount of Co incorporated in Fe-alloys increases, some Fe alloys increase in Curie point (Tc), while another decrease in that point. For this reason, the substitution of Fe with Co generally causes complicated results which are almost unexpectable. As an example, reference is made to the substitution of Fe in $RFe_3$ compounds with Co. As the amount of Co increases, Tc first increases and peakes substantially at a point where a half of Fe is replaced by Co, say, $R(Fe_{0.5}Co_{0.5})_3$ is obtained, and thereafter decreases. In the case of $Fe_2B$ alloys, Tc decreases with certain gradient by the substitution of Fe with Co.

According to the present invention, it has been noted that, as illustrated in FIG. 1, Tc increases with increases in the amount of Co, when Fe of the Fe—B—R system is substituted with Co. Parallel tendencies have been observed in all the Fe—B—R type alloys regardless of the type of R. Even a slight amount of Co is effective for the increase in Tc and, as will be seen from a (77—x)Fe—xCo—8B—15Nd alloy shown by way of example in FIG. 1, it is possible to obtain alloys having any desired Tc between about 310° and about 750° C. by regulation of x. In the Co-substituted Fe—B—R base permanent magnets according to the present invention, the total composition or B, R and (Fe plus Co) is essentially identical with that of the Fe—B—R base alloys (without Co).

Boron (B) shall be used on the one hand in an amount no less than 2% so as to meet a coercive force of 1 kOe or higher and, on the other hand, in an amount of not higher than 28% so as to exceed the residual magnetic flux density Br of about 4 kG of hard ferrite. R shall be used on the one hand in an amount no less than 8% so as to obtain a coercive force of 1 kOe or higher and, on the other hand, in an amount of 30% or less since it is easy to burn, incurs difficulties in handling and preparation, and is expensive.

The present invention offers an advantage in that less expensive light-rare earth element occurring abundantly in nature can be used as R since Sm is not necessarily requisite nor necessarily requisite as a main component.

The rare earth elements used in the magnetic materials and the permanent magnets according to the present invention include light- and heavy-rare earth elements inclusive of Y, and may be applied alone or in combination. Namely, R includes Nd, Pr, La, Ce, Tb, Dy, Ho, Er, Eu, Sm, Gd, Pm, Tm, Yb, Lu and Y. Preferably, the light rare earth elements amount to no less than 50 at % of the overall rare earth elements R, and particular preference is given to Nd and Pr. More preferably Nd plus Pr amounts to no less than 50 at % of the overall R. Usually, the use of one rare earth element will suffice, but, practically, mixtures of two or more rare earth elements such as mischmetal, didymium, etc. may be used due to their ease in avilability. Sm, Y, La, Ce, Gd and the like may be used in combination-with other rare earth elements such as Nd, Pr, etc. These rare earth elements R are not always pure rare earth elements and, hence, may contain impurities which are inevitably entrained in the production process, as long as they are technically available.

Boron represented by B may be pure boron or ferroboron, and those containing as impurities Al, Si, C etc. may be used.

Having a composition of 8–30 at % R, 2–28 at % B, 50 at % or less Co, and the balance Fe with the substantially tetragonal system crystal structure after sintering and a mean crystal grain size of 1–100 μm, the permanent magnets according to the present invention have magnetic properties such as coercive force Hc of ≧1 kOe, and residual magnetic flux density Br of ≧4 kG, and provide a maximum energy product (BH)max value which is at least equivalent or superior to the hard ferrite on the order of up to 4 MGOe). Due to the presence of Co in an amount of 5% or more the thermal coefficient of Br is about 0.1%/°C. or less. If R ranges from 12 to 24%, and B from 3 to 27%, (BH) max≧about 7 MGOe is obtainable so far as R and B concern.

When the light rare earth elements are mainly used as R (i.e., those elements amount to 50 at % or higher of the overall R) and a composition is applied of 12–24 at % R, 4–24 at % B, 5–45 at % Co, with the balance being Fe, maximum energy product (BH) max of ≧10 MGOe and said thermal coefficient of Br as above are attained. These ranges are more preferable, and (BH)max reaches 33 MGOe or higher.

Figure 12:
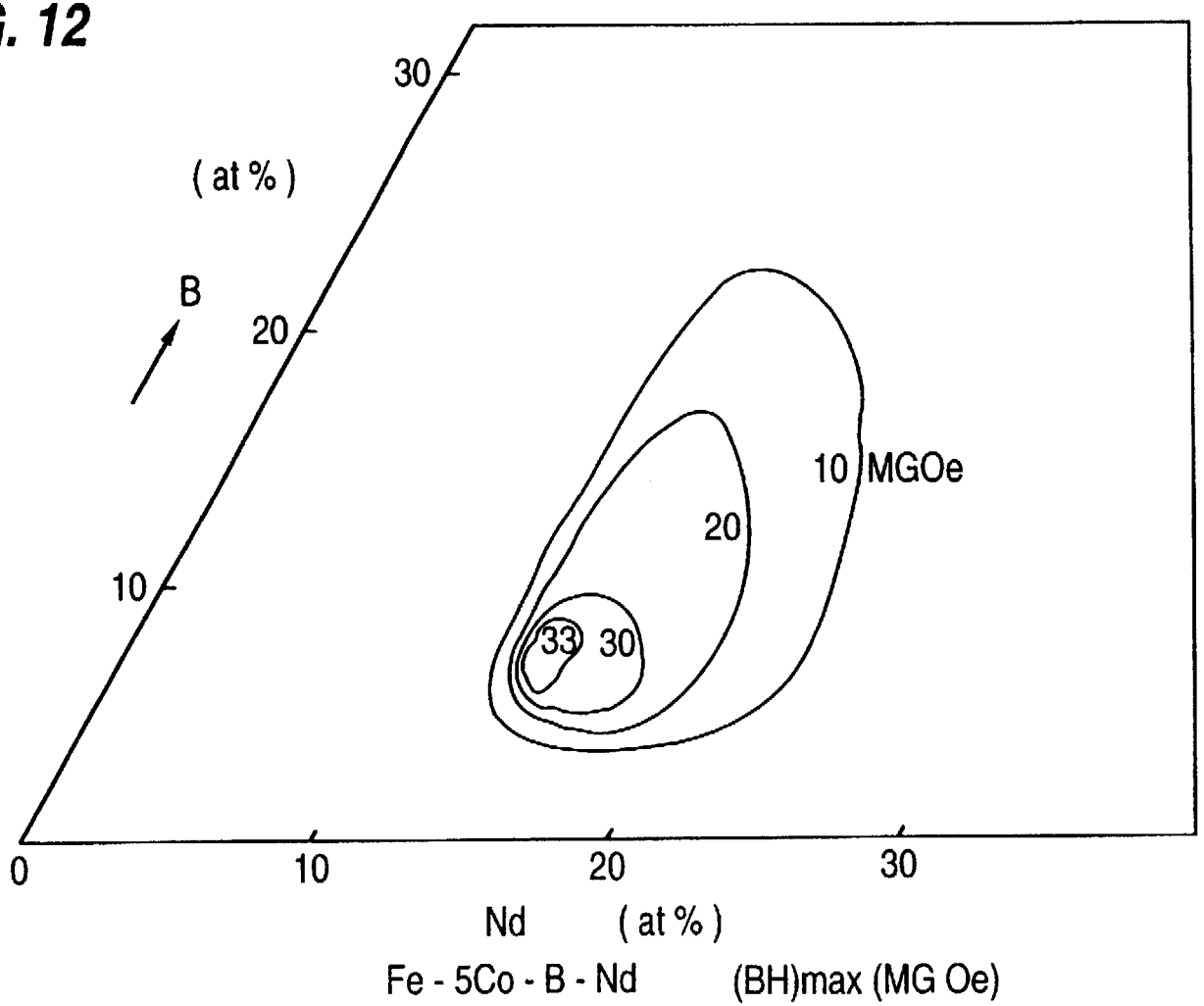
FIG. 12 is a Fe—B—R ternary system diagram showing compositional ranges corresponding to the maximum energy products (BH)max (MGOe) for one embodiment of an Fe—5Co—B—R system.
Figure 13:
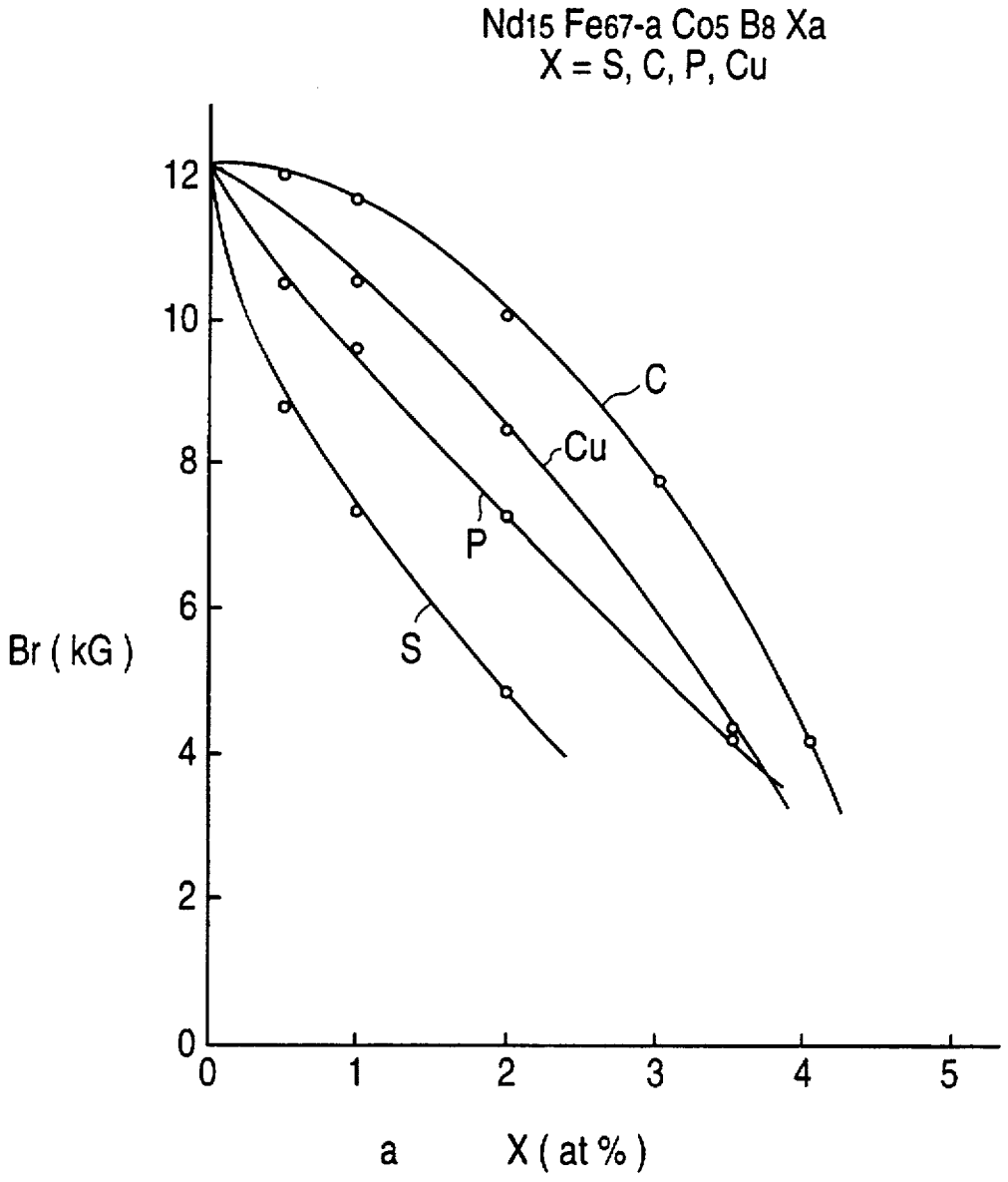
FIG. 13 is a graph showing the relationship between the amount of Cu, C, P and S (abscissa) and Br of one embodiment of the present invention.

Referring to the Fe—5Co—B—R system for instance the ranges surrounded with contour lines of (BH)max 10, 20, 30 and 33 MGOe in FIG. 12 define the respective energy products. The Fe—20Co—B—R system can provide substantially the same results.

Compared with the Fe—B—R ternary magnets, the Co-containing Fe—B—R base magnets of the present invention have better resistance against the temperature dependency, substantially equivalent Br, equivalent or slightly less iHc, and equivalent or higher (BH)max since the loop squareness or rectangularity is improved due to the presence of Co.

Since Co has a corrosion resistance higher than Fe, it is possible to afford corrosion resistance to the Fe—B—R base magnets by incorporation of Co. Particularly Oxidation resistance will simplify the handling the powdery materials and for the final powdery products.

As stated in the foregoing, the present invention provides embodiments of magnetic materials and permanent magnets which comprise 8 to 30 at % R (R representing at least one of rare earth element including yttrium), 2 to 28 at % B, 50 at % or less Co (except that the amount of Co is zero), and the balance being Fe and impurities which are inevitably entrained in the process of production (referred to "Fe—Co—B—R type".

The present invention provides further embodiments which contain one or more additional elements M selected from the group given below in the amounts of no more than the values specified below wherein when two or more elements of M are contained, the sum of M is no more than the maximum value among the values specified below of said elements M actually added and the amount of M is more than zero:

| | | |
|---|---|---|
| 4.5% Ti, | 8.0% Ni, | 5.0% Bi, |
| 9.5% V, | 12.5% Nb, | 10.5% Ta, |
| 8.5% Cr, | 9.5% Mo, | 9.5% W, |
| 8.0% Mn, | 9.5% Al, | 2.5% Sb, |
| 7.0% Ge, | 3.5% Sn, | 5.5% Zr, |
| and 5.5% Hf. | | |

The incorporation of the additional elements M enhances Hc resulting in an improved loop squareness.

The allowable limits of typical impurities contained in the final or finished products of magnetic materials or magnets are up to 3.5, preferably 2.3, at % for Cu; up to 2.5, preferably 1.5, at % for S; up to 4.0, preferably 3.0, at % for C; up to 3.5, preferably 2.0, at % for P; and at most 1 at % for O (oxygen), with the proviso that the total amount thereof is up to 4.0, preferably 3.0, at %. Above the upper limits, no energy product of 4 MGOe is obtained, so that such magnets as contemplated in the present invention are not obtained (see FIG. 11). With respect to Ca, Mg and Si, they are allowed to exist each in an amount up to about 8 at %, preferably with the proviso that their total amount shall not exceed about 8 at %. It is noted that, although Si has effect upon increases in Curie point, its amount is preferably about 8 at % or less, since iHc decreases sharply in an amount exceeding 5 at %. In some cases Ca and Mg may abundantly be contained in R raw materials such as commercially available Neodymium or the like.

Iron as a starting material for instance includes following impurities (by wt %) not exceeding the values below: 0.03 C, 0.6 Si, 0.6 Mn, 0.5 P, 0.02 S, 0.07 Cr, 0.05 Ni, 0.06 Cu, 0.05 Al, 0.05 $O_2$ and 0.003 $N_2$.

Electrolytic iron generally with impurities as above mentioned of 0.005 wt % or less is available.

Impurities included in starting ferroboron (19–13% B) alloys are not exceeding the values below, by wt %: 0.1 C, 2.0 Si, 10.0 Al, etc.

Starting neodymium material includes impurities, e.g., other rare earth element such as La, Ce, Pr and Sm; Ca, Mg, Ti, Al, O, C or the like; and further Fe, Cl, F or Mn depending upon the refining process.

The permanent magnets according to the present invention are prepared by a so-called powder metallurgical process, i.e., sintering, and can be formed into any desired shape and size, as already mentioned. However, desired practical permanent magnets (bodies) were not obtained by such a melt-quenching process as applied in the preparation of amorphous thin film alloys, resulting in no practical coercive force at all.

On the other hand, no desired magnetic properties (particularly coercive force) were again obtained at all by melting, casting and aging used in the production of alnico magnets, etc. The reason is presumed to be that crystals having a coarser grain size and a ununiform composition are obtained. Other various techniques have been attempted, but none have given any results as contemplated.

In accordance with the present invention, however, practical permanent magnets (bodies) of any desired shape are obtained by forming and sintering powder alloys, which magnets have the end good magnetic properties and mechanical strength. For instance, the powder alloys are obtainable by melting, casting and grinding or pulverization.

The sintered bodies can be used in the as-sintered state as useful permanent magnets, and may of course be subjected to aging as is the case in the conventional magnets.

The foregoing discussions also hold for both the Fe—Co—B—R system and the Fe—Co—B—R—M system.

PREPARATION OF MAGNETIC MATERIALS

Typically, the magnetic materials of the present invention may be prepared by the process forming the previous stage of the overall process for the preparation of the permanent magnets of the present invention. For example, various elemental metals are melted and cast into alloys having a tetragonal system crystal structure, which are then finely ground into fine powders.

As the magnetic material use may be made of the powdery rare earth oxide $R_2O_3$ (a raw material for R). This may be heated with powdery Fe, powdery Co, powdery FeB and a reducing agent (Ca, etc) for direct reduction. The resultant powder alloys show a tetragonal system as well.

The powder alloys can further be sintered into magnetic materials. This is true for both the Fe—Co—B—R base and the Fe—Co—B—R—M base magnetic materials.

The Fe—Co—B—R base magnets of the present invention will now be explained with reference to the examples. Which are given for the purpose of illustration alone, and are not intended to limit the invention.

FIG. 1 typically illustrates changes in Curie point Tc of 77Fe—8B—15Nd wherein part of Fe is substituted with Co(x) and (77—x)Fe—xCo—8B—15Nd wherein x varies from 0 to 77. The samples were prepared in the following steps.

(1) Alloys were melted by high-frequency melting and cast in a water-cooled copper mold. As the starting materials for Fe, B and R use was made of, by weight ratio for the purity, 99.9% electrolytic iron, ferroboron alloys of 19.38% B, 5.32 % Al, 0.74% Si, 0.03% C and the balance Fe, and a rare earth element or elements having a purity of 99.7% or higher with the impurities being mainly other rare earth elements, respectively. As Co, electrolytic Co having a purity of 99.9% was used.

(2) Pulverization: The castings were coarsely ground in a stamp mill until they pass through a 35-mesh sieve, and then finely pulverized in a ball mill for 3 hours to 3–10 μm.

(3) The resultant powders were oriented in a magnetic field of 10 kOe and compacted under a pressure of 1.5 $t/cm^2$.

(4) The resultant compacts were sintered at 1000°–1200° C. for about one hour in an argon atmosphere and therefore, allowed to cool.

Blocks weighing about 0.1 g were obtained from the sintered bodies by cutting, and measured on their Curie points using a vibrating sample magnetometer in the following manner. A magnetic field of 10 kOe was applied to the samples, and changes in $4\pi I$ depending upon temperature were determined in a temperature range of from 250° C. to 800° C. A temperature at which $4\pi I$ reduced virtually to zero was taken as Curie point Tc.

In the above-mentioned systems, Tc increased rapidly with the increase in the amount of Co replaced for Fe, and exceeded 600° C. in Co amounts of no less than 30%.

In the permanent magnets, increases in Tc are generally considered to be the most important factor for reducing the changes in the magnetic properties depending upon temperature. To ascertain this point, a number of permanent magnet samples as tabulated in Table 1 were prepared according to the procedures as applied for the preparation of those used in Tc measurements to determine the temperature dependency of Br.

(5) The changes in Br depending upon temperature were measured in the following manner. Magnetization curves are obtained at 25° C., 60° C. and 100° C., respectively, using a BH tracer, and the chances in Br at between 25° and 60° C. and between 60° and 100° C. were averaged. Table 1 shows the thermal coefficient of Br and the measurement results of magnetization curves at 25° C., which were obtained of various Fe—B—R and Fe—Co—B—R base magnets.

From Table 1, it is evident that the changes in Br depending upon temperature are reduced by incorporation of Co into the Fe—B—R base magnets. Namely, thermal coefficients of about 0.1%/°C. or less are obtained if Co is 5% or more.

Table 1 also shows the magnetic properties of the respective samples at room temperature.

In most of the compositions, iHc generally decreases due to the Co substitution, but (BH)max increases due to the improved loop rectangularity of the magnetization curves. However, iHc decreases if the amount of Co increases from 25 to 50% finally reaching about the order of 1.5 kOe. Therefore the amount of Co shall be no higher than 50% so as to obtain iHc≧1 kOe suitable for permanent magnets.

From Table 1 and FIG. 1 the relationship between the Co amount and the magnetic properties is apparent. Namely, even a small amount of Co is correspondingly effective for the improvement of Tc. In a range of 25% or less Co, other magnetic properties (particularly, the energy product) are substantially not affected. (See, samples *2, and 8–12 of Table 1). If Co exceeds 25%, (BH)max also decreases.

Figure 2:
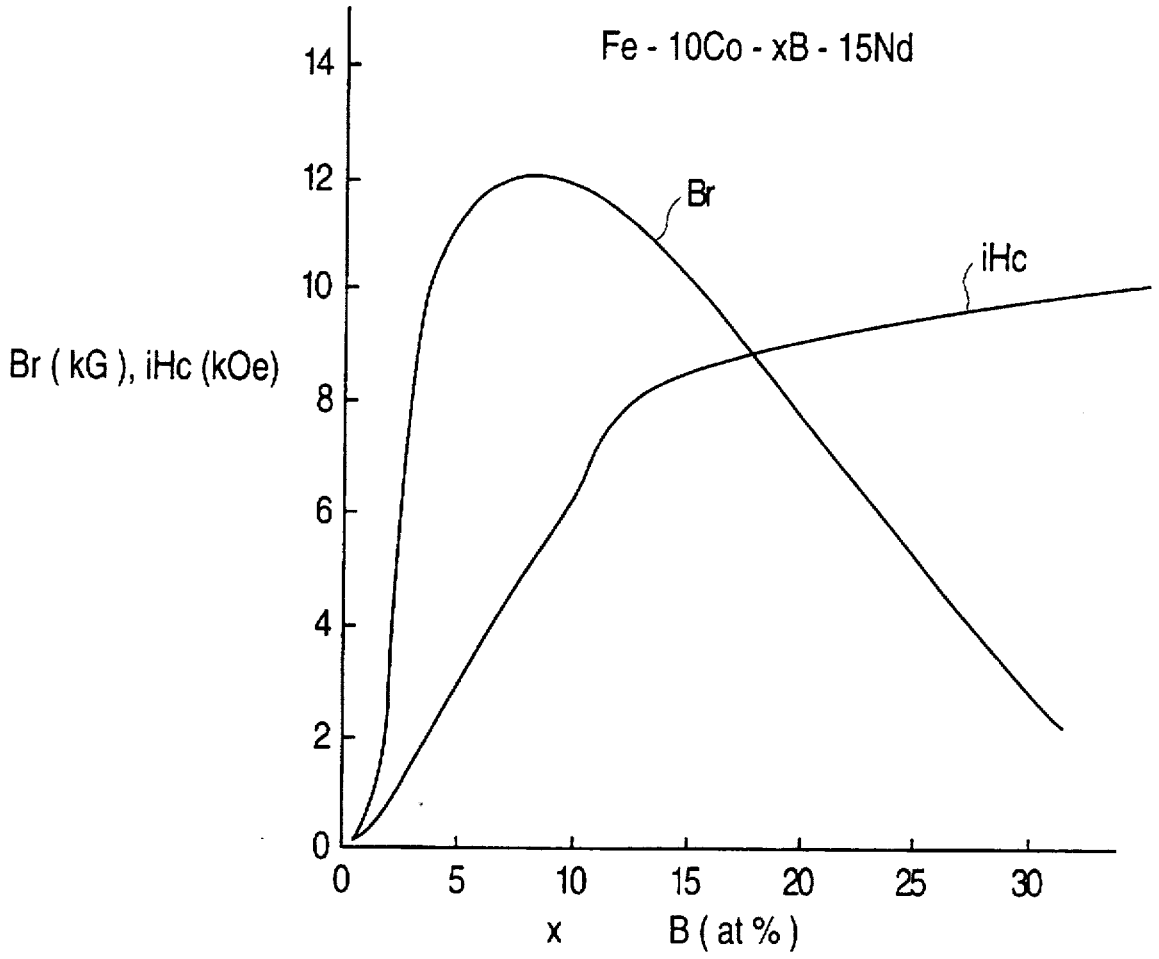
FIG. 2 is a graph showing the relationship between the amount of B and Br as well as iHc (kOe) of one embodiment of Fe—10Co—xB—15Nd, with the atomic percent of B as abscissa.
Figure 3:
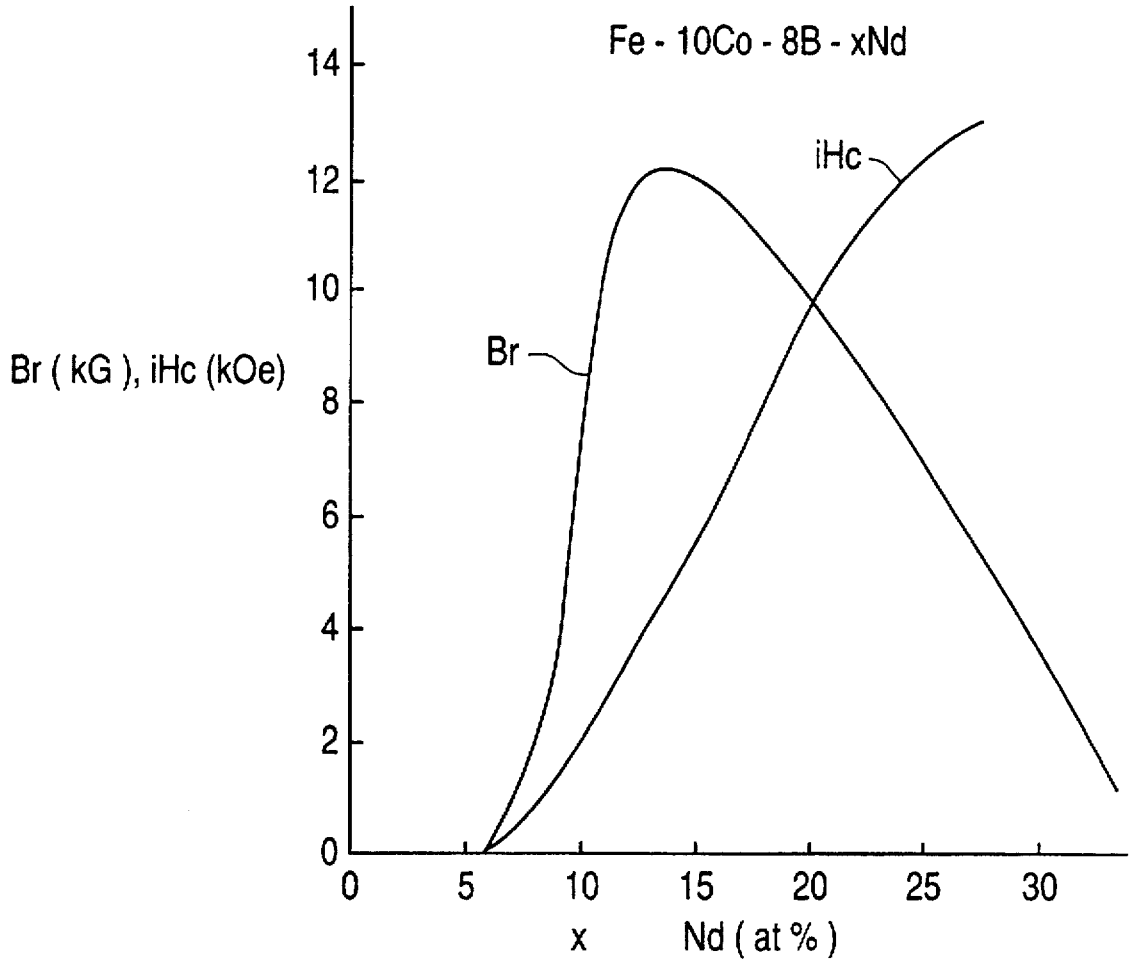
FIG. 3 is a graph showing the relationship between the amount of Nd and Br (kG) as well as iHc (kOe) of one embodiment of Fe—10Co—8B—xNd, with the atomic percent of Nd as abscissa.

The reasons already given in connection with the upper and lower limits of B and the lower limit of R will be confirmed from Table 1, FIG. 2 and FIG. 3.

TABLE 1

| No. | compositions (at %) | thermal coefficient of Br (%/°C.) | iHc (kOe) | Br (kG) | (BH)max (MGOe) |
|---|---|---|---|---|---|
| *1 | Fe-2B-15Nd | 0.14 | 1.0 | 9.6 | 4.0 |
| *2 | Fe-8B-15Nd | 0.14 | 7.3 | 12.1 | 32.1 |
| *3 | Fe-17B-15Nd | 0.15 | 7.6 | 8.7 | 17.6 |
| *4 | Fe-17B-30Nd | 0.16 | 14.8 | 4.5 | 4.2 |
| *5 | Fe-20Co-15Nd | — | 0 | 0 | 0 |
| *6 | Fe-10Co-19B-5Pr | — | 0 | 0 | 0 |
| *7 | Fe-60Co-8B-15Nd | 0.05 | 0.8 | 8.2 | 3.5 |
| 8 | Fe-10Co-8B-15Nd | 0.09 | 5.2 | 12.0 | 33.0 |
| 9 | Fe-20Co-8B-15Nd | 0.07 | 8.8 | 12.0 | 33.1 |
| 10 | Fe-30Co-8B-15Nd | 0.06 | 4.5 | 12.0 | 24.2 |
| 11 | Fe-40Co-8B-15Nd | 0.06 | 3.1 | 11.8 | 17.5 |
| 12 | Fe-50Co-8B-15Nd | 0.06 | 1.5 | 8.7 | 7.7 |
| 13 | Fe-15Co-17B-15Nd | 0.10 | 7.4 | 8.9 | 18.2 |
| 14 | Fe-30Co-17B-15Nd | 0.08 | 6.3 | 8.6 | 16.5 |
| 15 | Fe-20Co-8B-10Tb-3Ce | 0.08 | 6.1 | 6.3 | 8.8 |
| 16 | Fe-20Co-12B-14Pr | 0.07 | 7.2 | 10.5 | 25.0 |
| 17 | Fe-15Co-17B-8Nd-5Pr | 0.08 | 7.4 | 8.3 | 15.7 |
| 18 | Fe-20Co-11B-3Sm-13Pr | 0.07 | 6.5 | 9.6 | 17.5 |
| 19 | Fe-10Co-15B-8Nd-7Y | 0.09 | 6.0 | 7.5 | 11.0 |
| 20 | Fe-10Co-14B-7Nd-3Pr -5La | 0.09 | 6.8 | 7.8 | 14.2 |
| 21 | Fe-30Co-17B-28Nd | 0.09 | 12.2 | 4.6 | 4.7 |

N.B.: prefix * refers to comparative tests

As a typical embodiment of the sintered magnetic magnets of the Fe—Co—B—R system in which part of Fe is substituted with Co. FIG. 2 shows an initial magnetization curve 1 for 57Fe—20Co—8B—15Nd at room temperature.

Figure 4:
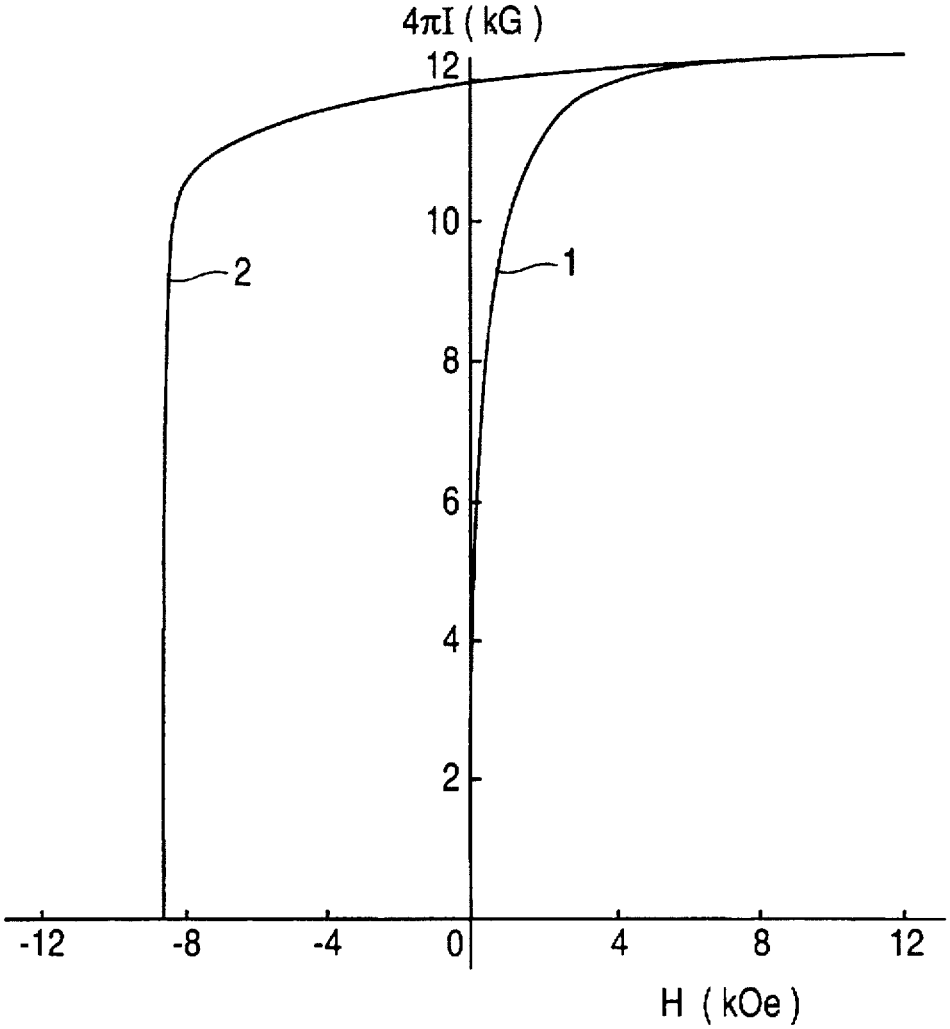
FIG. 4 is a view showing the demagnetization curves of one embodiment of the present invention (1 is the initial magnetization curve 2 the demagnetization curve), with 4πI (kG) as ordinate and a magnetic field H (kOe) as abscissa.

The initial magnetization curve 1 rises steeply in a low magnetic field, and reaches saturation. The demagnetization curve 2 shows very high loop rectangularity, which indicates that the magnet is a typical high-performance anisotropic magnet. From the form of the initial magnetization curve 1, it is thought that this magnet is a so-called nucleation type permanent magnet since the SmCo type magnets of the nucleation type shows an analogous curve, wherein the coercive force of which is determined by nucleation occurring in the inverted magnetic domain. The high loop rectangularity of the demagnetization curve 2 indicates that this magnet is a typical high-performance anisotropic magnet. Other samples according to the present invention set forth in Table 1 all showed magnetization curves similar to that of FIG. 4.

A number of magnets using primarily as R light-rare earth element such as Nd, Pr, etc., are shown in Table 1, from which it is noted that they possess high magnetic properties, and have their temperature dependency further improved by the substitution of Fe with Co. It is also noted that the use of a mixture of two or more rare earth element as R is also useful.

Permanent magnet samples of Fe—Co—B—R—M alloys containing as M one of two additional elements were prepared in a manner similar to that applied for the preparation of the Fe—Co—B—R base magnets.

The additional elements M used were Ti, Mo, Bi, Mn, Sb, Ni, Sr, Ce and Ta each having a purity of ag %, by weight so far as the purity concerns as hereinbelow, W having a purity of 98%, Al having a purity of 99.9%, and Hf having a purity of 95%. As V ferrovanadium containing 81.2% of V; as Nb ferroniobium containing 67.6% of Nb, as Cr ferrochromium containing 61.9% of Cr; and as Zr ferrozirconium containing 75.5% of Zr were used, respectively.

A close examination of the samples having a variety of compositions was carried out by the determination of iHc, Br, (BH)max, etc. As a result, it has been found that, in quintinary or multicomponent systems based on Fe—Co—B—R—M (wherein M represents one or two or more additional elements) there is a certain region in which high permanent magnet properties are developed.

Table 2 shows the maximum energy product (BH)max, which is the most important factor of the permanent magnet properties, of typical samples. In Table 2, Fe is the balance.

From Table 2, it has been appreciated that the Fe—Co—B—R—M base magnets have high energy product of 10 MGOe or greater over a wide compositional range.

This table mainly enumerates the examples of alloys containing Nd and Pr, but any of 15 rare earth element (Y, La, Ce; Pr, Nd, Sm, Eu, Gd, Tb, Dy, Ho, Er, Tm, Yb; Lu) give rise to increase in (BH)max. However, the alloys containing Nd and Pr according to the present invention are more favorable than those containing as the main materials other rarer rare earth element (Sm, Y and heavy-rare element), partly because Nd and Pr occur relatively abundantly in rare earth ores, and especially because no applications of Nd in larger amounts have been found.

Figure 5:
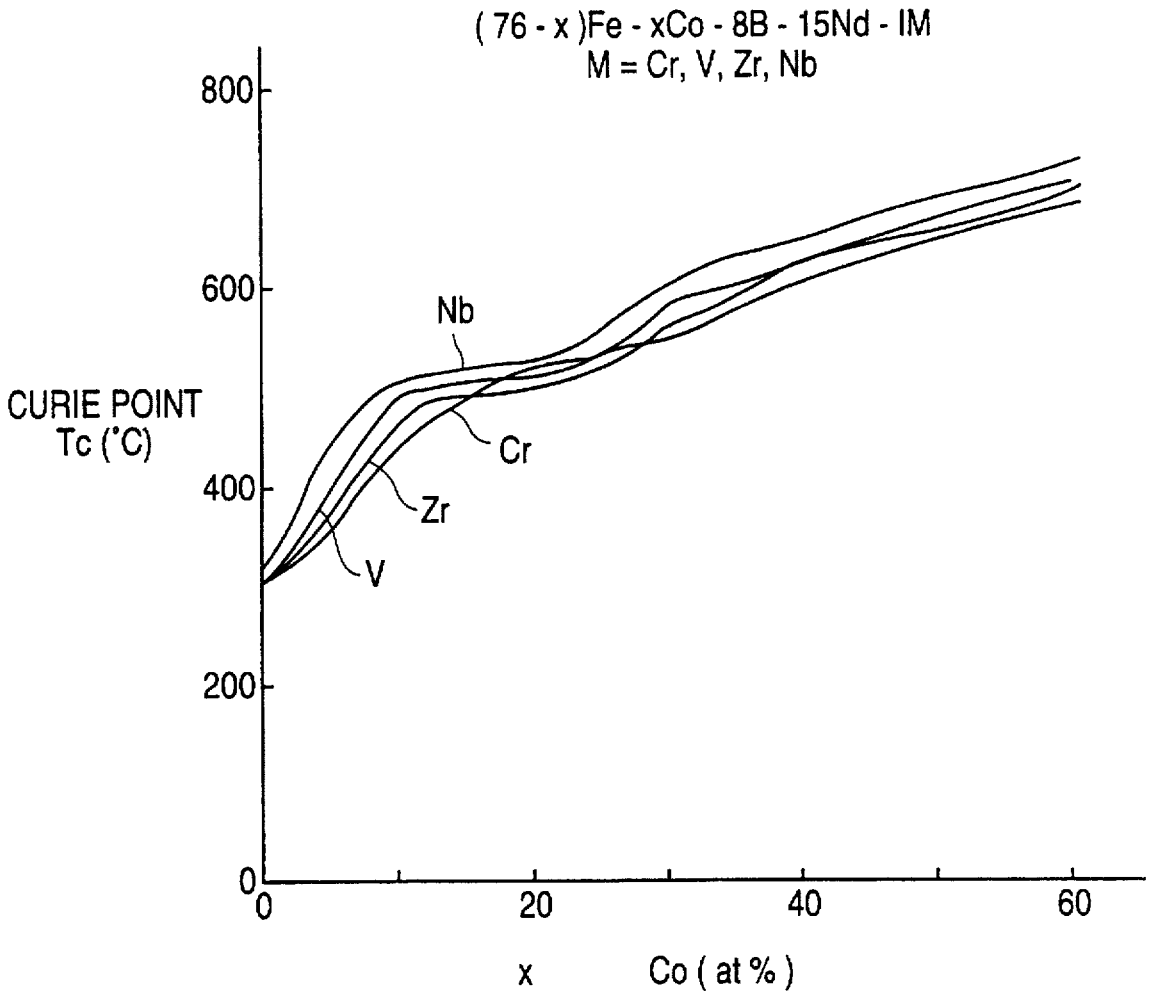
FIG. 5 is a graph showing the relationship between the amount of Co (abscissa) and the Curie point of one embodiment of the present invention.

Also in the Fe—Co—B—R—M alloys, Co has no noticeable influence upon (BH)max, when it is added in an amount of 25% or less and Co contributes to the increase in the Curie points with the increasing Co amount as is the case for the Fe—Co—B—R alloys. For instance, comaparisons of Sample Nos. 48 with 50, 58 with 60, and 68 with 70 reveal that a compositional difference in the amount of Co (1 to 10 Co) between these alloys causes no noticeable difference in (BH)max. FIG. 5 shows the relationship between the Curie point and the amount of Co (by at %) of the Fe—Co—B—R—M alloys wherein M is V, Nb, Zr and Cr, and indicates that the Curie point increases with increases in the amount of Co, but the addition of M gives rise to substantially no remarkable change in the Curie point.

Parallel tendencies have been observed in the Fe—Co—B—R—M fundamental alloys regardless of the type of R. Even a slight amount of Co, e.g., 1% is effective for Tc increases, and it is possible to obtain alloys having any desired Tc between about 310 ° C. and about 750° C. by varying of x, as will be evident from the (76—x) Fe—xCo—8B—15Nd—1M system exemplified in FIG 5.

Accordingly, it has turned out that with respect to the Fe—Co—B—R—M system the relationships between the Co amount and the magnetic properties, and between the ranges of B and R and the magnetic properties are established analogoulsy to the Fe—Co—B—R system previously discussed, provided that the effect of the additional elements M acts additionally.

The Fe—Co—B—R—M magnets according to the present invention have Curie points higher than the Fe—B—R—M magnets without Co.

Figure 6:
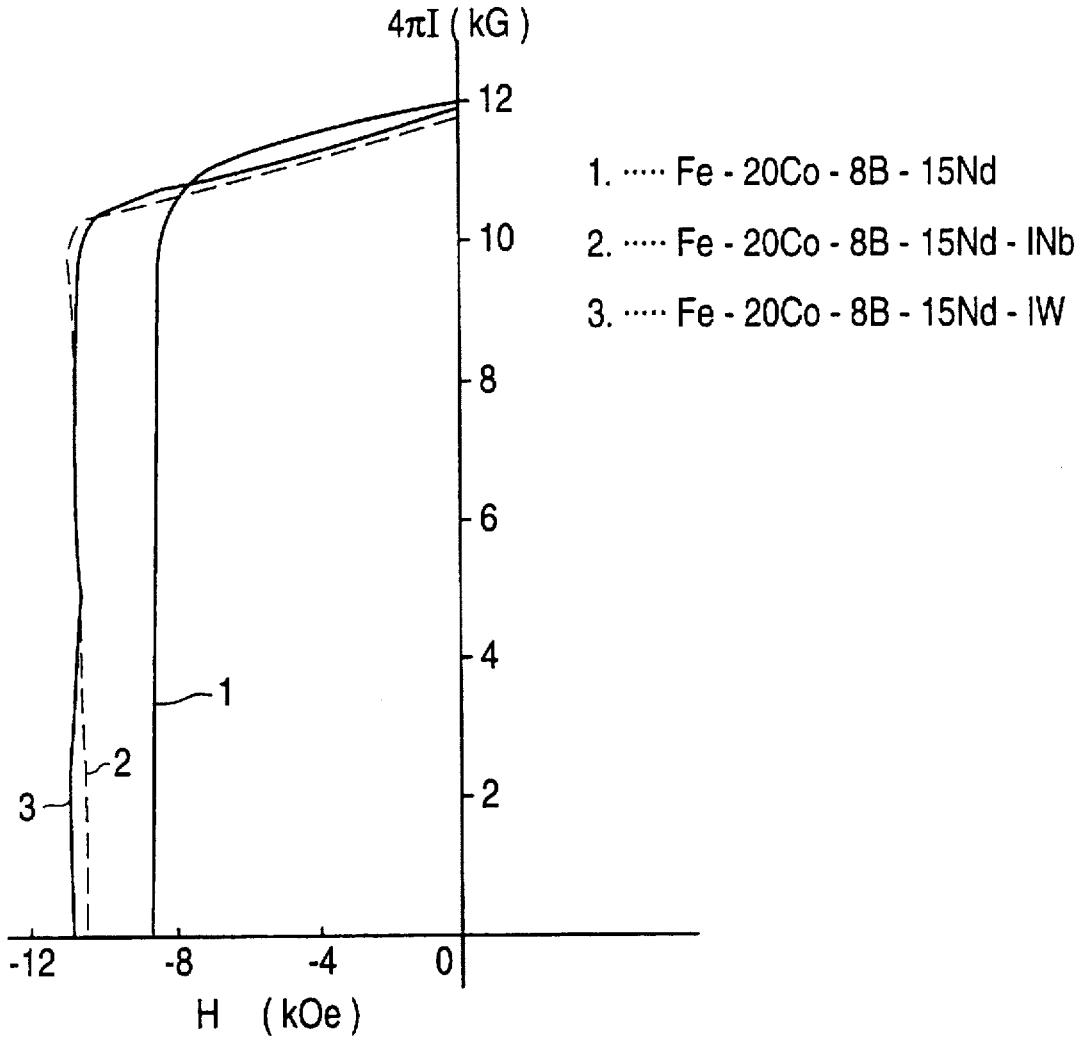
FIG. 6 is a graph showing the demagnetization curves of one embodiment of the present invention, with a magnetic field H (kOe) as abscissa and 4πI (kG) as ordinate.

In the Fe—Co—B—R—M magnets, most of M have an effect upon increases in Hc. FIG. 6 shows the demagnetization curves of the typical examples of the Fe—Co—B—R—M magnets and M-free Fe—Co—B—R magnets given for the purpose of comparison. In this figure, reference numerals 1 to 3 denote the demagnetization curves of a M-free magnet, a Nb-containing magnet (Table 1 No.3) and a W-containing magnet (Table 1 No. 83), respectively.

An increase in Hc due to the addition of M provides an increased stability and wide applicability of the permanent magnets. However, the greater the amount of M, the lower the Br and (BH)max will be, due to the fact that they are nonmagnetic materials (except Ni). Since permanent magnets having slightly reduced (BH)max but high Hc have recently been often required in certain fields, the addition of M is very useful, however, provided that (BH)max is at least 4 MGOe.

To ascertain the effect of M upon Br, Br was measured in varied amounts of M. The results are summarized in FIGS. 7 to 9. As seen from FIGS. 7 to 9, the upper limits of the additional elements M (Ti, Zr, Hf, V, Ta, Nb, Cr, W, Mo, Sb, Sn, Ge and Al) other than Bi, Ni, and Mn may be chosen such that Br is at least equivalent to about 4 kG of hard ferrite. A preferable range in view of Br should be appreciated from FIGS. 7 to 9 by defining the Br range into 6.5 kG, 8kG, 10 kG or the like stages.

Based on these figures, the upper limits of the amounts of additional elements M are fixed at the following values at or below which (BH)max is at least equivalent or superior to about 4 MGOe of hard ferrite:

| | | |
|---|---|---|
| 4.5% Ti, | 8.0% Ni, | 5.0% Bi, |
| 9.5% V, | 12.5% Nb, | 10.5% Ta, |
| 8.5% Cr, | 9.5% Mo | 9.5% W, |
| 8.0% Mn, | 9.5% Al, | 2.5% Sb, |
| 7.0% Ge, | 3.5% Sn, | 5.5% Zr, |
| and 5.5% Hf. | | |

Figure 7:
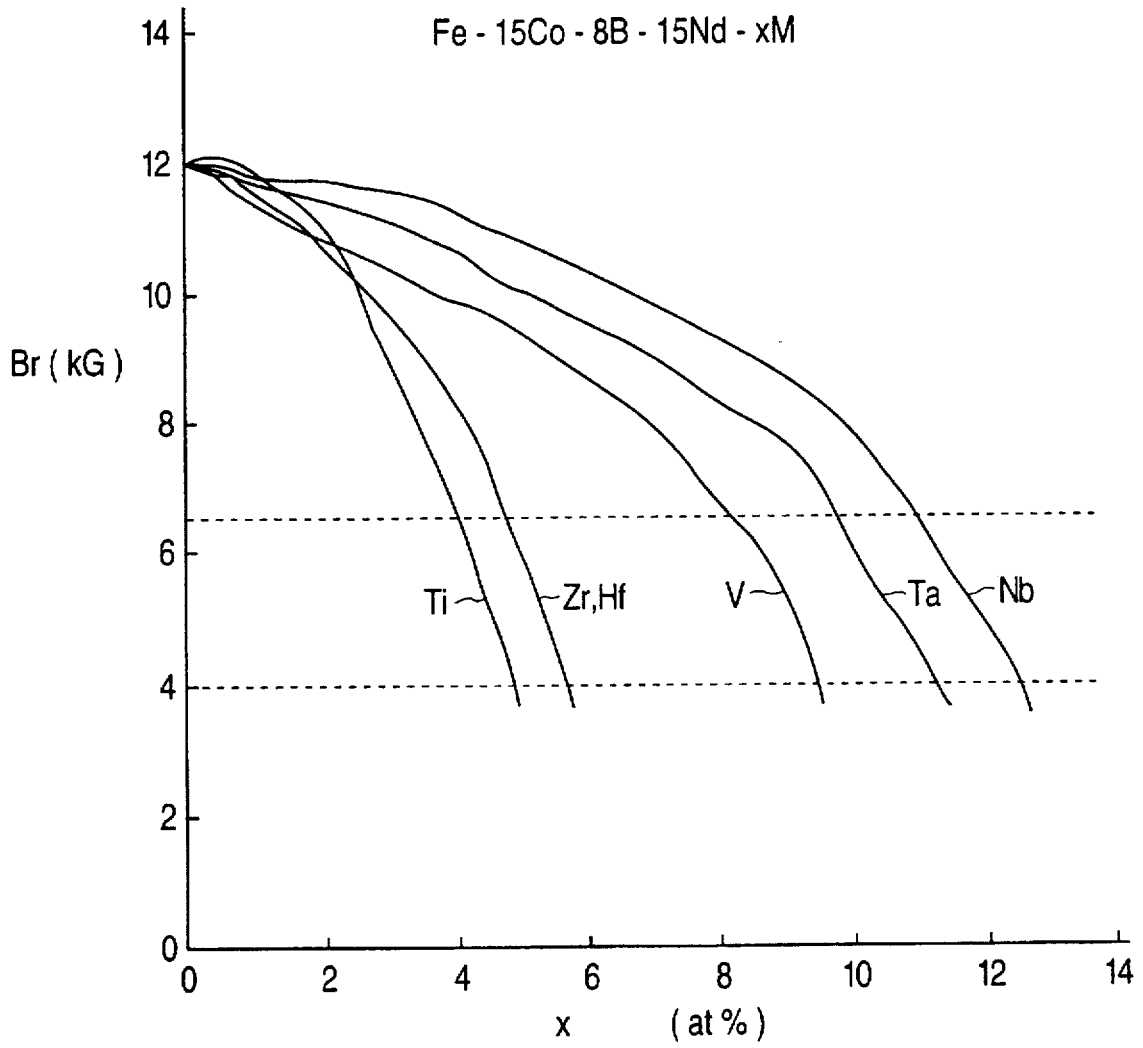
FIGS. 7 to 9 are graphs showing the relationship between the amount of additional elements M and the residual magnetization Br (kG)
Figure 8:
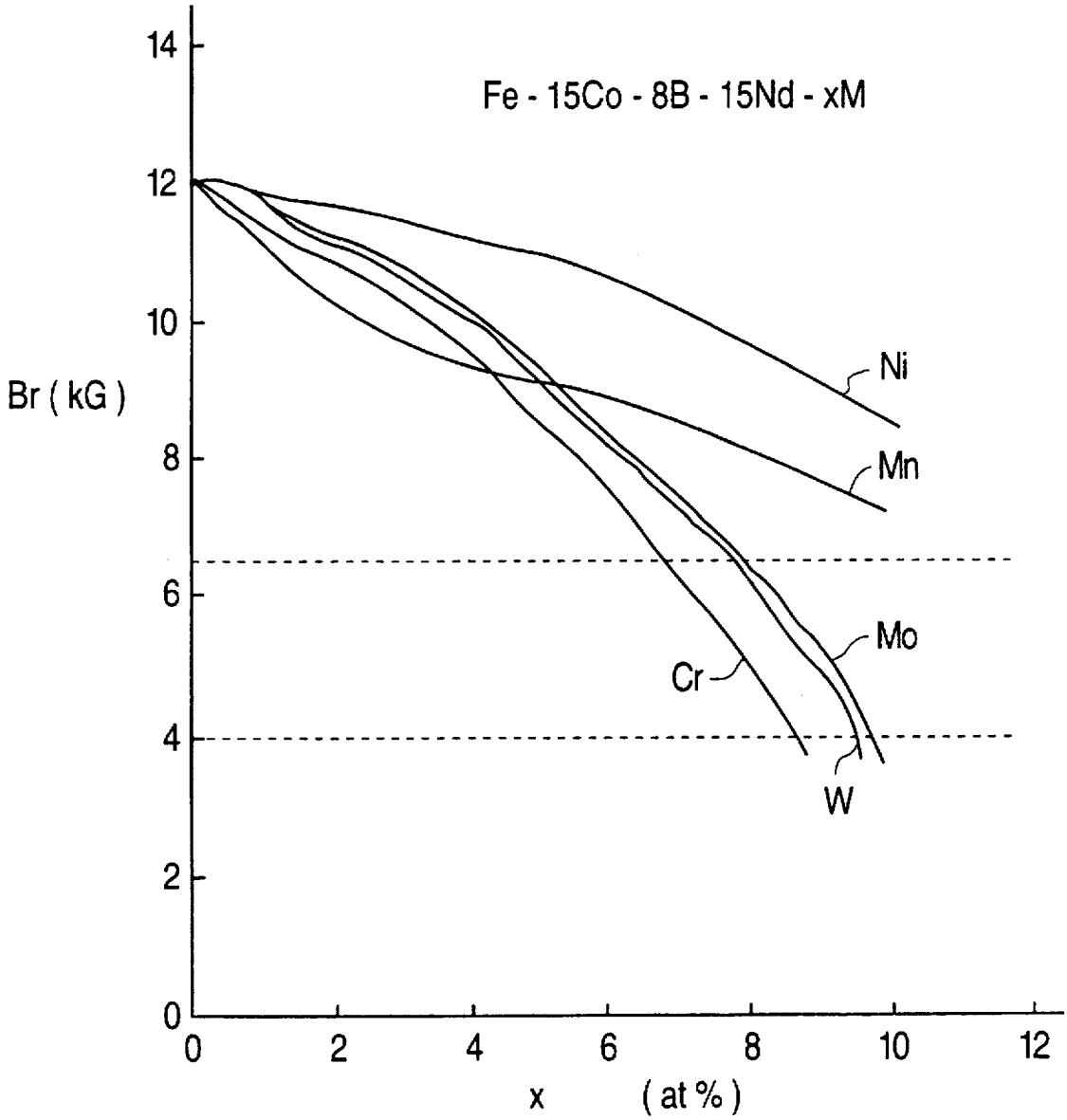
Figure 9:
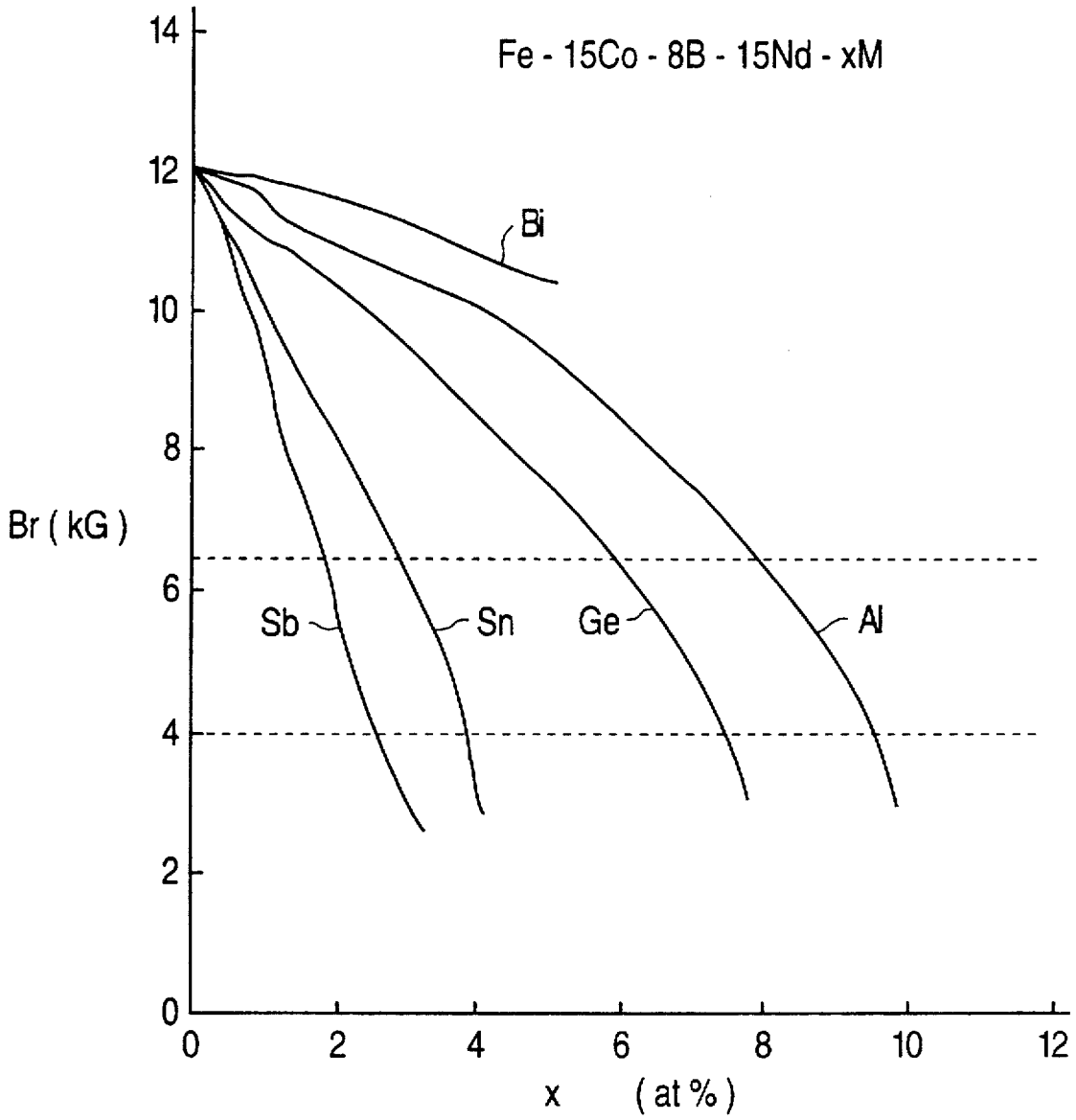

When two or more elements M are employed, the resulting characteristic curve will be depicted between the characteristic curves of the individual elements in FIG. 7 to 9. Thus each amount of the individual elements M are within each aforesaid range, and the total amount thereof is no more than the maximum values among the values specified for the individual elements which are actually added and present in a system. For instance, if Ti, V and Nb are addednt, the total amount of these must be no more than 12.5% in all.

A more preferable range for the amount of M is determined from a range of (BH)max within which it exceeds 10 MGOe of the highest grade alnico. In order that (BH)max is no less than 10 MGOe, Br of 6.5 kG or higher is required.

From FIGS. 7 to 9, the upper limits of the amounts of M are preferably defined at the following values:

| | | |
|---|---|---|
| 4.0% Ti, | 6.5% Ni, | 5.0% Bi, |
| 8.0% V, | 10.5% Nb, | 9.5% Ta, |
| 6.5% Cr, | 7.5% Mo, | 7.5% W, |
| 6.0% Mn, | 7.5% Al, | 1.5% Sb, |
| 5.5% Ge, | 2.5% Sn, | 4.5% Zr, |
| and 4.5% Hf | | |

wherein two or more additional elements M are used, the preferable ranges for M are obtained when the individual elements are no higher than the aforesaid upper limits, and the total amount thereof is no higher than the maximum values among the values allowed for the individual pertinent elements which are actually added and present.

Within the upper limits of M, when the Fe—Co—B—R base system preferably comprises 4 to 24% of B, 11 to 24% of R (light-rare earth elements, primarily Nd and Pr), and the balance being the given amounts of Fe and Co, (BH)max of 10 MGOe or higher is obtained within the preferable ranges of the additional elements M, and reaches or exceeds the (BH)max level of hard ferrite within the upper limit of M.

Even when the Fe—Co—B—R base system departs from the above-mentioned preferable range, (BH)max exceeding that of hard ferrite is obtained, if the additional element M are in the above-mentioned preferable range. According to more preferable embodiments of the present invention, the permanent magnets have (BH)max of 15, 20, 25, 30 and even 33 MGOe or higher.

In general, the more the amount of M, the lower the Br; however, most elements of M serve to increase iHc. Thus, (BH)max assumes a value practically similar to that obtained with the case where no M is applied, through the addition of an appropriate amount of M, and may reach at most 33 MGOe or higher. The increase in coercive force serves to stabilize the magnetic properties, so that permanent magnets are obtained which are practically very stable and have a high energy product.

If large amounts of Mn and Ni are incorporated, iHc will decrease; there is only slilght decrease in Br due to the fact that Ni is a ferromagnetic element (see FIG. 8). Therefore, the upper limit of Ni is 8%, preferably 6.5%, in view of Hc.

The effect of Mn upon decrease in Br is not strong but larger than is the case with Ni. Thus, the upper limit of Mn is 8%, preferably 6%, in view of iHc.

With respect to Bi, its upper limit shall be 5%, since any alloys having a Bi content exceeding 5% cannot practically be produced due to extremely high vapor pressure.

TABLE 2 - 1

| sample No. | compositions (at %) | (BH)max (MGOe) |
|---|---|---|
| 1 | Fe-2Co-8B-15Nd-2Al | 29.5 |
| 2 | Fe-5Co-8B-15Nd-0.5Al | 35.2 |
| 3 | Fe-5Co-17B-15Nd-4Al | 11.5 |
| 4 | Fe-10Co-17B-17Nd-0.5Al | 12.7 |
| 5 | Fe-10Co-8B-15Nd-1Al | 31.6 |
| 6 | Fe-20Co-8B-12Nd-0.5Al | 23.0 |
| 7 | Fe-35Co-6B-24Nd-5Al | 10.5 |
| 8 | Fe-5Co-17B-15Nd-2.5Ti | 11.0 |
| 9 | Fe-10Co-13B-14Nd-2Ti | 18.1 |
| 10 | Fe-20Co-12B-16Nd-1Ti | 22.1 |
| 11 | Fe-35Co-8B-15Nd-0.5Ti | 20.5 |
| 12 | Fe-35Co-6B-25Nd-0.3Ti | 12.4 |
| 13 | Fe-2Co-8B-16Nd-2V | 24.0 |
| 14 | Fe-5Co-6B-15Nd-0.3V | 31.1 |
| 15 | Fe-5Co-8B-14Nd-6V | 16.3 |
| 16 | Fe-10Co-17B-15Nd-1V | 14.8 |
| 17 | Fe-20Co-8B-12Nd-0.5V | 21.6 |
| 18 | Fe-20Co-15B-17Nd-1V | 17.2 |
| 19 | Fe-35Co-6B-25Nd-1V | 15.2 |
| 20 | Fe-2Co-8B-16Nd-2Cr | 22.4 |

TABLE 2 - 2

| sample No. | compositions (at %) | (BH)max (MGOe) |
|---|---|---|
| 21 | Fe-5Co-20B-15Nd-0.5Cr | 12.0 |
| 22 | Fe-5Co-7B-14Nd-4Cr | 18.1 |

TABLE 2 - 2-continued

| sample No. | compositions (at %) | (BH)max (MGOe) |
|---|---|---|
| 23 | Fe-10Co-8B-15Nd-0.5Cr | 32.7 |
| 24 | Fe-10Co-17B-12Nd-0.2Cr | 17.2 |
| 25 | Fe-20Co-8B-15Nd-0.5Cr | 31.7 |
| 26 | Fe-20Co-8B-15Nd-1Cr | 30.5 |
| 27 | Fe-35Co-6B-25Nd-1Cr | 14.7 |
| 28 | Fe-2Co-8B-13Nd-0.5Mn | 30.1 |
| 29 | Fe-5Co-7B-14Nd-1Mn | 25.1 |
| 30 | Fe-10Co-9B-15Nd-1Mn | 21.0 |
| 31 | Fe-20Co-8B-16Nd-1Mn | 24.9 |
| 32 | Fe-20Co-16B-14Nd-0.2Mn | 17.1 |
| 33 | Fe-20Co-7B-14Nd-4Mn | 14.5 |
| 34 | Fe-35Co-9B-20Nd-1Mn | 14.2 |
| 35 | Fe-5Co-8B-15Nd-1Zr | 32.3 |
| 36 | Fe-10Co-9B-14Nd-1Zr | 32.2 |
| 37 | Fe-10Co-17B-16Nd-6Zr | 12.9 |
| 38 | Fe-10Co-6B-20Nd-0.5Zr | 18.1 |
| 39 | Fe-20Co-8B-12Nd-0.5Zr | 25.6 |
| 40 | Fe-20Co-20B-14Nd-0.3Zr | 13.2 |

TABLE 2 - 3

| sample No. | compositions (at %) | (BH)max (MGOe) |
|---|---|---|
| 41 | Fe-35Co-8B-20Nd-1Zr | 16.0 |
| 42 | Fe-5Co-8B-15Nd-1Hf | 32.2 |
| 43 | Fe-10Co-9B-14Nd-1Hf | 32.0 |
| 44 | Fe-10Co-17B-16Nd-6Hf | 13.1 |
| 45 | Fe-20Co-8B-12Nd-0.5Hf | 17.9 |
| 46 | Fe-20Co-20B-14Nd-0.3Hf | 25.2 |
| 47 | Fe-35Co-6B-20Nd-1Hf | 15.7 |
| 48 | Fe-1Co-8B-16Nd-0.5Nb | 33.3 |
| 49 | Fe-2Co-8B-14Nd-1Nb | 35.5 |
| 50 | Fe-10Co-8B-15Nd-0.5Nb | 33.4 |
| 51 | Fe-10Co-7B-14Nd-1Nb | 33.1 |
| 52 | Fe-20Co-9B-14Nd-0.5Nb | 33.1 |
| 53 | Fe-20Co-8B-15Nd-1Nb | 31.3 |
| 54 | Fe-20Co-17B-13Nd-6Nb | 10.7 |
| 55 | Fe-20Co-8B-15Nd-8Nb | 14.8 |
| 56 | Fe-20Co-6B-25Nd-1Nb | 16.8 |
| 57 | Fe-35Co-7B-15Nd-3Nb | 21.6 |
| 58 | Fe-1Co-8B-16Nd-0.5Ta | 32.5 |
| 59 | Fe-2Co-8B-14Nd-1Ta | 31.5 |
| 60 | Fe-10Co-8B-15Nd-0.5Ta | 32.3 |

TABLE 2 - 4

| sample No. | compositions (at %) | (BH)max (MGOe) |
|---|---|---|
| 61 | Fe-10Co-7B-14Nd-1Ta | 31.2 |
| 62 | Fe-20Co-9B-14Nd-0.5Ta | 31.5 |
| 63 | Fe-20Co-7B-16Nd-1Ta | 30.3 |
| 64 | Fe-20Co-15B-13Nd-6Ta | 10.5 |
| 65 | Fe-20Co-8B-15Nd-8Ta | 11.6 |
| 66 | Fe-20Co-6B-25Nd-1Ta | 15.6 |
| 67 | Fe-35Co-7B-15Nd-3Ta | 20.0 |
| 68 | Fe-1Co-8B-15Nd-0.5Mo | 35.1 |
| 69 | Fe-2Co-8B-15Nd-1Mo | 34.7 |
| 70 | Fe-10Co-8B-16Nd-0.5Mo | 33.0 |
| 71 | Fe-10Co-7B-14Nd-1Mo | 31.0 |
| 72 | Fe-20Co-9B-14Nd-0.5Mo | 31.0 |
| 73 | Fe-20CO-6B-16Nd-1Mo | 32.2 |
| 74 | Fe-20Co-17B-13Nd-2Mo | 14.6 |
| 75 | Fe-20Co-8B-13Nd-6Mo | 14.3 |
| 76 | Fe-20Co-6B-25Nd-1Mo | 16.4 |
| 77 | Fe-35Co-7B-15Nd-3Mo | 18.8 |
| 78 | Fe-1Co-8B-15Nd-0.5W | 33.6 |
| 79 | Fe-2Co-8B-16Nd-1W | 33.2 |
| 80 | Fe-10Co-8B-16Nd-0.5W | 33.7 |

TABLE 2 - 5

| sample No. | compositions (at %) | (BH)max (MGOe) |
|---|---|---|
| 81 | Fe-10Co-7B-14Nd-1W | 32.3 |
| 82 | Fe-20Co-9B-14Nd-0.5W | 32.5 |
| 83 | Fe-20Co-8B-15Nd-1W | 32.4 |
| 84 | Fe-20Co-17B-13Nd-2W | 14.5 |
| 85 | Fe-20Co-8B-13Nd-6W | 16.2 |
| 86 | Fe-20Co-6B-25Nd-1W | 16.0 |
| 87 | Fe-35Co-7B-15Nd-3W | 18.4 |
| 88 | Fe-5Co-8B-15Nd-1Ge | 22.2 |
| 89 | Fe-10Co-9B-4Nd-2Ge | 11.4 |
| 90 | Fe-10Co-17B-16Nd-0.5Ge | 14.2 |
| 91 | Fe-20Co-6B-20Nd-0.5Ge | 17.2 |
| 92 | Fe-20Co-8B-12Nd-0.3Ge | 25.3 |
| 93 | Fe-20Co-20B-14Nd-0.5Ge | 10.5 |
| 94 | Fe-35Co-6B-20Nd-1Ge | 10.1 |
| 95 | Fe-5Co-8B-15Nd-1Sb | 13.2 |
| 96 | Fe-10Co-9B-14Nd-0.5Sb | 15.4 |
| 97 | Fe-10Co-17B-16Nd-1Sb | 11.1 |
| 98 | Fe-20Co-6B-20Nd-0.1Sb | 21.2 |
| 99 | Fe-20Co-8B-12Nd-1.2Sb | 12.0 |
| 100 | Fe-20Co-20B-14Nd-0.5Sb | 10.5 |

TABLE 2 - 6

| sample No. | compositions (at %) | (BH)max (MGOe) |
|---|---|---|
| 101 | Fe-35Co-6B-20Nd-0.5Sb | 10.2 |
| 102 | Fe-5Co-8B-15Nd-1Sn | 20.2 |
| 103 | Fe-10Co-9B-14Nd-0.5Sn | 26.1 |
| 104 | Fe-10Co-17B-16Nd-0.5Sn | 11.2 |
| 105 | Fe-20Co-6B-20Nd-0.5Sn | 15.1 |
| 106 | Fe-20Co-8B-12Nd-1Sn | 15.0 |
| 107 | Fe-20Co-20B-14Nd-0.5Sn | 10.4 |
| 108 | Fe-35Co-6B-20Nd-0.5Sn | 10.9 |
| 109 | Fe-5Co-8B-15Nd-0.2Bi | 31.5 |
| 110 | Fe-10Co-9B-14Nd-0.5Bi | 29.6 |
| 111 | Fe-10Co-17B-16Nd-1Bi | 16.0 |
| 112 | Fe-20Co-6B-20Nd-3Bi | 15.8 |
| 113 | Fe-20Co-8B-12Nd-1.5Bi | 21.9 |
| 114 | Fe-20Co-20B-14Nd-1Bi | 10.9 |
| 115 | Fe-35Co-6B-20Nd-0.5Bi | 18.2 |
| 116 | Fe-5Co-8B-15Nd-1Ni | 24.3 |
| 117 | Fe-10Co-9B-14Nd-4Ni | 17.1 |
| 118 | Fe-10Co-17B-16Nd-0.2Ni | 16.2 |
| 119 | Fe-20Co-6B-20Nd-5Ni | 15.8 |
| 120 | Fe-20Co-8B-12Nd-0.5Ni | 25.3 |

TABLE 2 - 7

| sample No. | compositions (at %) | (BH)max (MGOe) |
|---|---|---|
| 121 | Fe-20Co-20B-14Nd-1Ni | 15.3 |
| 122 | Fe-35Co-6B-20Nd-3Ni | 15.3 |
| 123 | Fe-5Co-3B-15Pr-1Al | 24.8 |
| 124 | Fe-10Co-9B-14Pr-1W | 26.5 |
| 125 | Fe-5Co-17B-14Pr-2V | 10.7 |
| 126 | Fe-10Co-8B-16Pr-0.5Cr | 23.2 |
| 127 | Fe-20Co-8B-17Pr-0.5Mn | 21.3 |
| 128 | Fe-20Co-8B-15Pr-1Zr | 25.4 |
| 129 | Fe-10Co-7B-14Pr-1Mo-1Zr | 20.3 |
| 130 | Fe-10Co-7B-14Nd-0.5Al-1V | 29.1 |
| 131 | Fe-10Co-9B-15Nd-2Nb-0.5Sn | 22.8 |
| 132 | Fe-20Co-8B-16Nd-1Cr-1Ta-0.5Al | 22.5 |
| 133 | Fe-20Co-8B-14Nd-1Nb-0.5W-0.5Ge | 22.1 |
| 134 | Fe-20Co-15B-15Pr-0.5Zr-0.5Ta-0.5Ni | 10.9 |
| 135 | Fe-10Co-17B-10Nd-5Pr-0.5W | 16.2 |
| 136 | Fe-10Co-8B-8Nd-7Ho-1Al | 19.9 |
| 137 | Fe-10Co-7B-9Nd-5Er-1Mn | 20.1 |
| 138 | Fe-5Co-8B-10Nd-5Gd-1Cr | 21.5 |
| 139 | Fe-10Co-9B-10Nd-5La-1Nb | 19.3 |

TABLE 2 - 7-continued

| sample No. | compositions (at %) | (BH)max (MGOe) |
|---|---|---|
| 140 | Fe-20Co-10B-10Nd-5Ce-0.5Ta | 20.1 |
| 141 | Fe-20Co-7B-11Nd-4Dy-1Mn | 19.5 |

The relationship between the crystal grain size and the magnetic properties of the Fe—Co—B—R base magnets will be described in detail hereinbelow.

The pulverization procedure as previously mentioned was carried out for varied periods of time selected in such a manner that the measured mean particle sizes of the powder ranged from 0.5 to 100 μm. In this manner, various samples having the compositions as specified in Table 3 were obtained.

Comparative Examples: To obtain a crystal grain size of 100 μm or greater, the sintered bodies were maintained for prolonged time in an argon atmosphere at a temperature lower than the sintered temperature by 5°–20° C.

From the thus prepared samples having the compositions as specified in Table 3 were obtained magnets which were studied to determine their magnetic properties and their mean crystal grain sizes. The results are set forth in Table 3. The mean crystal grain size referred to herein was measured in the following manner:

From the sample Nos. *7 and *8, it is found that Hc drops to less 1 kOe if the crystal grain size departs from the scope as defined in the present invention.

Figure 10:
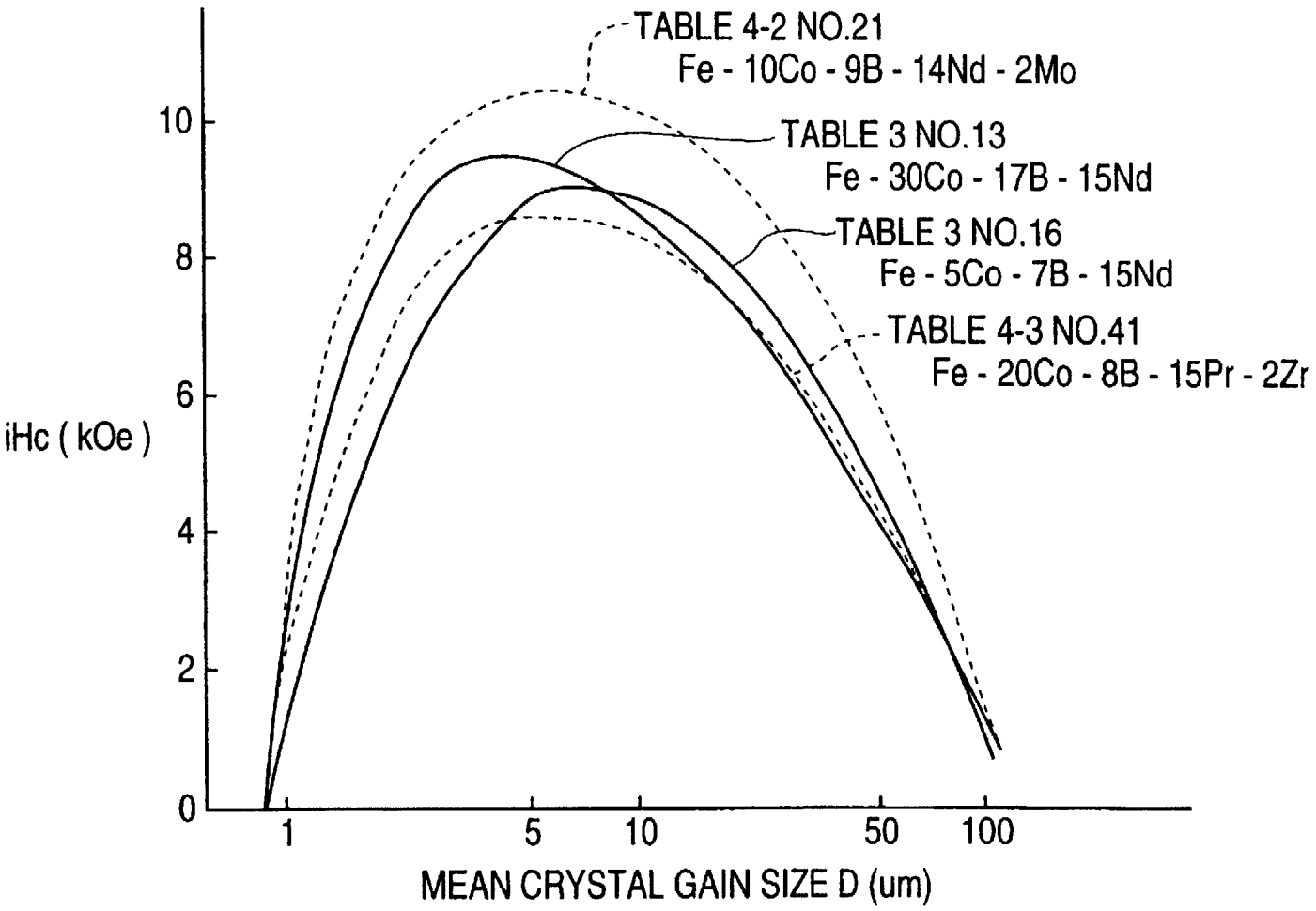
FIG. 10 is a graph showing the relationship between iHc and the mean crystal grain size D (log-scale abscissa in μm) of one embodiment of the present invention.

Samples designated as Nos. 13 and 16 in Table 3 were studied in detail in respect of the relationship between their mean crystal grain size D and Hc. The results are illustrated in FIG. 10, from which it is found that Hc peaks when D is approximately in a range of 3–10 μm, decrease steeply when D is below that range, and drops moderately when D is above that range. Even when the composition varies within the scope as defined in the present invention, the relationship between the mean crystal grain size D and Hc is substantially maintained. This indicates that the Fe—Co—B—R system magnets are the single domain particle type magnets.

From the results given in Table 3 and FIG. 10, it is evident that, in order for the Fe—CO—B—R base magnets to possess Br of about 4 kG of hard ferrite or more and Hc of no less than 1 kOe, the composition comes within the range as defined in the present invention and the mean crystal grain size D is 1–100 μm, and that, in order to obtain Hc of no less than 4 kOe, the mean crystal grain size should be in a range of 1.5–50 μm.

Control of the crystal grain size of the sintered compact can be carried out by controlling process conditions such as pulverization, sintering, post heat treatment, etc.

TABLE 3

| No. | compositions (at %) | mean crystal grain size D (μm) | thermal coefficient of Br (%/°C.) | magnetic properties iHc (kOe) | Br (kG) | (BH)max (MGOe) |
|---|---|---|---|---|---|---|
| *1 | Fe-2B-15Nd | 6.0 | 0.14 | 1.0 | 9.6 | 4.0 |
| *2 | Fe-8B-15Nd | 5.5 | 0.14 | 9.5 | 12.3 | 33.2 |
| *3 | Fe-32B-15Nd | 10.1 | 0.16 | 11.0 | 2.5 | 1.3 |
| *4 | Fe-17B-30Nd | 7.3 | 0.16 | 14.8 | 4.5 | 4.2 |
| *5 | Fe-10Co-15B-5Pr | 22.0 | — | 0 | 0 | 0 |
| *6 | Fe-60Co-10B-13Nd | 15.7 | 0.07 | 0.6 | 7.9 | 2.8 |
| *7 | Fe-20Co-12B-14Pr | 110 | 0.09 | <1 | 5.7 | 1.8 |
| *8 | Fe-40Co-17B-15Nd | 0.85 | 0.07 | <1 | 6.1 | 1.4 |
| 9 | Fe-20Co-12B-14Pr | 8.8 | 0.09 | 6.8 | 10.4 | 19.5 |
| 10 | Fe-40Co-17B-15Nd | 2.8 | 0.06 | 6.5 | 9.2 | 17.1 |
| 11 | Fe-50Co-8B-15Nd | 4.7 | 0.06 | 1.5 | 8.7 | 5.5 |
| 12 | Fe-5Co-8B-15Nd | 29.0 | 0.11 | 6.4 | 11.3 | 25.2 |
| 13 | Fe-30Co-17B-15Nd | 36.5 | 0.08 | 5.2 | 8.6 | 13.6 |
| 14 | Fe-15Co-16B-16Pr | 68.0 | 0.09 | 3.6 | 10.2 | 9.4 |
| 15 | Fe-20Co-7B-15Nd | 5.6 | 0.09 | 8.6 | 12.1 | 31.9 |
| 16 | Fe-5Co-7B-15Nd | 6.5 | 0.11 | 9.0 | 12.5 | 34.2 |
| 17 | Fe-20Co-11B-8Nd-7Pr | 17.5 | 0.09 | 6.3 | 9.5 | 14.7 |
| 18 | Fe-10Co-11B-7Nd-3Pr-5La | 22.3 | 0.10 | 4.8 | 7.7 | 9.8 |
| 19 | Fe-30Co-17B-22Nd | 13.5 | 0.08 | 4.4 | 5.4 | 4.8 |
| 20 | Fe-10Co-10B-5Ho-10Nd | 19.0 | 0.10 | 6.6 | 8.9 | 15.7 |
| 21 | Fe-10Co-10B-13Nd-2Dy-1La | 15.5 | 0.10 | 6.8 | 10.0 | 22.3 |
| 22 | Fe-20Co-9B-10Nd-6Pr-1Sm | 10.3 | 0.10 | 5.7 | 10.4 | 21.5 |
| 23 | Fe-15Co-7B-14Nd-2Gd | 7.5 | 0.10 | 4.7 | 9.7 | 16.7 |

The samples were polished and corroded on their surfaces, and photographed through an optical microscope at a magnification ranging from ×100 to ×1000. Circles having known areas were drawn on the photographs, and divided by lines into eight equal sections. The number of grains present on the diameters were counted and averaged. However, grains on the borders (circumferences) were counted as half grains (this method is known as Heyn's method). Pores were omitted from calculation.

In Table 3, the samples marked * represent comparative examples.

The embodiments and effects of the M-containing Fe—Co—B—R base magnets (Fe—Co—B—R—M magnets) will now be explained with reference to the following examples given for the purpose of illustration alone and intended not to limit the invention.

Tables 4-1 to 4-3 show properties of the permanent magnets comprising a variety of Fe—Co—B—R—M compounds, which were prepared by melting and pulverization of alloys, followed by forming of the resulting powders in a magnetic field then sintering. Permanent magnets departing from the scope of the present invention are also shown with mark *. It is noted that the preparation of samples were substantially identical with that of the Fe—Co—B—R base magnets.

From the samples having the compositions as shown in Tables 4-1 to 4-3 were obtained magnets whose magnetic properties and mean crystal grain size were measured. The results are set out in Table 4-1 to 4-3.

TABLE 4 - 1

| No. | compositions (at %) | mean crystal grain size D (μm) | (BH)max (MGOe) |
|---|---|---|---|
| 1 | Fe-2Co-8B-15Nd-2Al | 4.8 | 29.5 |
| 2 | Fe-30Co-17B-13Nd-4Al | 7.4 | 17.6 |
| 3 | Fe-10Co-13B-14Nd-2Ti | 10.1 | 16.6 |
| 4 | Fe-10Co-13B-14Nd-2Ti | 75.0 | 4.3 |
| 5 | Fe-20Co-13B-16Nd-0.5Ti | 3.2 | 27.5 |
| 6 | Fe-35Co-8B-20Nd-1Ti | 25.0 | 11.2 |
| 7 | Fe-2Co-17B-16Nd-2V | 55.0 | 8.3 |
| 8 | Fe-20Co-12B-12Nd-0.5V | 5.2 | 21.5 |
| 9 | Fe-35Co-6B-20Nd-5V | 13.5 | 10.7 |
| 10 | Fe-5Co-7B-14Nd-3Cr | 8.7 | 16.0 |
| 11 | Fe-35Co-6B-23Nd-1Cr | 18.8 | 7.4 |
| 12 | Fe-15Co-16B-15Nd-1.5Mn | 21.2 | 14.6 |
| 13 | Fe-5Co-8B-17Nd-3Zr | 37.5 | 23.1 |
| 14 | Fe-10Co-20B-15Nd-0.5Hf | 28.0 | 12.6 |
| 15 | Fe-35Co-7B-20Nd-2Hf | 11.2 | 15.4 |
| 16 | Fe-3Co-8B-14Nd-1Nb | 5.0 | 36.0 |
| 17 | Fe-10Co-7B-17Nd-5Nb | 10.7 | 18.8 |
| 18 | Fe-5Co-15B-14Nd-1Ta | 16.2 | 11.4 |
| 19 | Fe-35Co-7B-15Nd-3Ta | 7.6 | 20.8 |
| 20 | Fe-2Co-8B-15Nd-0.5Mo | 6.5 | 33.5 |

TABLE 4 - 2

| No. | compositions (at %) | mean crystal grain size D (μm) | (BH) max (MGOe) |
|---|---|---|---|
| 21 | Fe-10Co-9B-14Nd-2Mo | 9.2 | 28.5 |
| 22 | Fe-20Co-17B-15Nd-2Mo | 26.2 | 22.4 |
| 23 | Fe-20Co-17B-14Nd-6Mo | 15.7 | 14.7 |
| 24 | Fe-20Co-7B-25Nd-1Mo | 9.5 | 15.4 |
| 25 | Fe-35Co-8B-17Nd-3Mo | 22.8 | 16.9 |
| 26 | Fe-2Co-7B-17Nd-0.5W | 11.2 | 32.2 |
| 27 | Fe-5Co-12B-17Nd-3W | 35.1 | 26.3 |
| 28 | Fe-10Co-8B-14Nd-1W | 3.8 | 35.4 |
| 29 | Fe-20Co-17B-15Nd-1W | 47.0 | 13.2 |
| 30 | Fe-20Co-8B-14Nd-6W | 27.3 | 14.8 |
| 31 | Fe-35Co-7B-15Nd-3W | 12.7 | 12.0 |
| 32 | Fe-20Co-8B-14Nd-1Ge | 18.2 | 10.7 |
| 33 | Fe-10Co-9B-16Nd-0.5Sb | 9.7 | 17.8 |
| 34 | Fe-20Co-17B-15Nd-1Sn | 6.0 | 18.8 |
| 35 | Fe-20Co-6B-20Nd-3Bi | 6.2 | 16.6 |
| 36 | Fe-5Co-8B-15Nd-3Ni | 16.8 | 14.8 |
| 37 | Fe-20Co-10B-l7Nd-1Ni | 8.4 | 19.2 |
| 38 | Fe-20Co-7B-16Nd-1Cu | 23.2 | 13.8 |
| 39 | Fe-5Co-8B-15Pr-1Al | 4.4 | 27.3 |
| 40 | Fe-10Co-10B-17Pr-1W | 5.7 | 26.4 |

TABLE 4 - 3

| No. | compositions (at %) | mean crystal grain size D (μm) | (BH) max (MGOe) |
|---|---|---|---|
| 41 | Fe-20Co-8B-15Pr-2Zr | 4.6 | 25.4 |
| 42 | Fe-15Co-8B-10Nd-5Pc-1Nb-1W | 7.3 | 28.1 |
| 43 | Fe-10Co-7B-15Nd-1La-1Ta-0.5Mn | 12.3 | 17.8 |
| 44 | Fe-20C0-12B-12Nd-3Ho-2W-0.5Hf | 2.8 | 22.3 |
| 45 | Fe-20Co-8B-11Nd-4Dy-1Al-0.5Cr | 14.1 | 18.6 |
| 46 | Fe-10Co-7B-10Nd-5Gd-1W-0.5Cu | 28.3 | 11.4 |
| 47 | Fe-12Co-8B-13Nd-1Sm-1Nb | 6.0 | 20.5 |

TABLE 4 - 3-continued

| No. | compositions (at %) | mean crystal grain size D (μm) | (BH) max (MGOe) |
|---|---|---|---|
| 48 | Fe-5Co-7B-14Nd-1Ce-1Mo | 9.4 | 18.3 |
| 49 | Fe-20Co-8B-13Nd-2Pr-1Y-1Al | 12.5 | 22.3 |

TABLE 5

| No. | compositions (at %) | mean crystal grain size D (μm) | magnetic properties iHc (kOe) | Br (kG) | (BH) max (MGOe) |
|---|---|---|---|---|---|
| *1 | 80Fe-20Nd | 15 | 0 | 0 | 0 |
| *2 | 53Fe-32B-15Nd | 10 | 11.0 | 2.5 | 1.3 |
| *3 | 48Fe-17B-35Nd | 4 | >15 | 1.4 | <1 |
| *4 | 73Fe-10B-17Nd | 0.7 | <1 | 5.0 | <1 |
| *5 | 82Fe-5B-13Nd | 140 | <1 | 6.3 | 2.2 |

N.B.: prefix * refers to comparative tests

Figure 11:
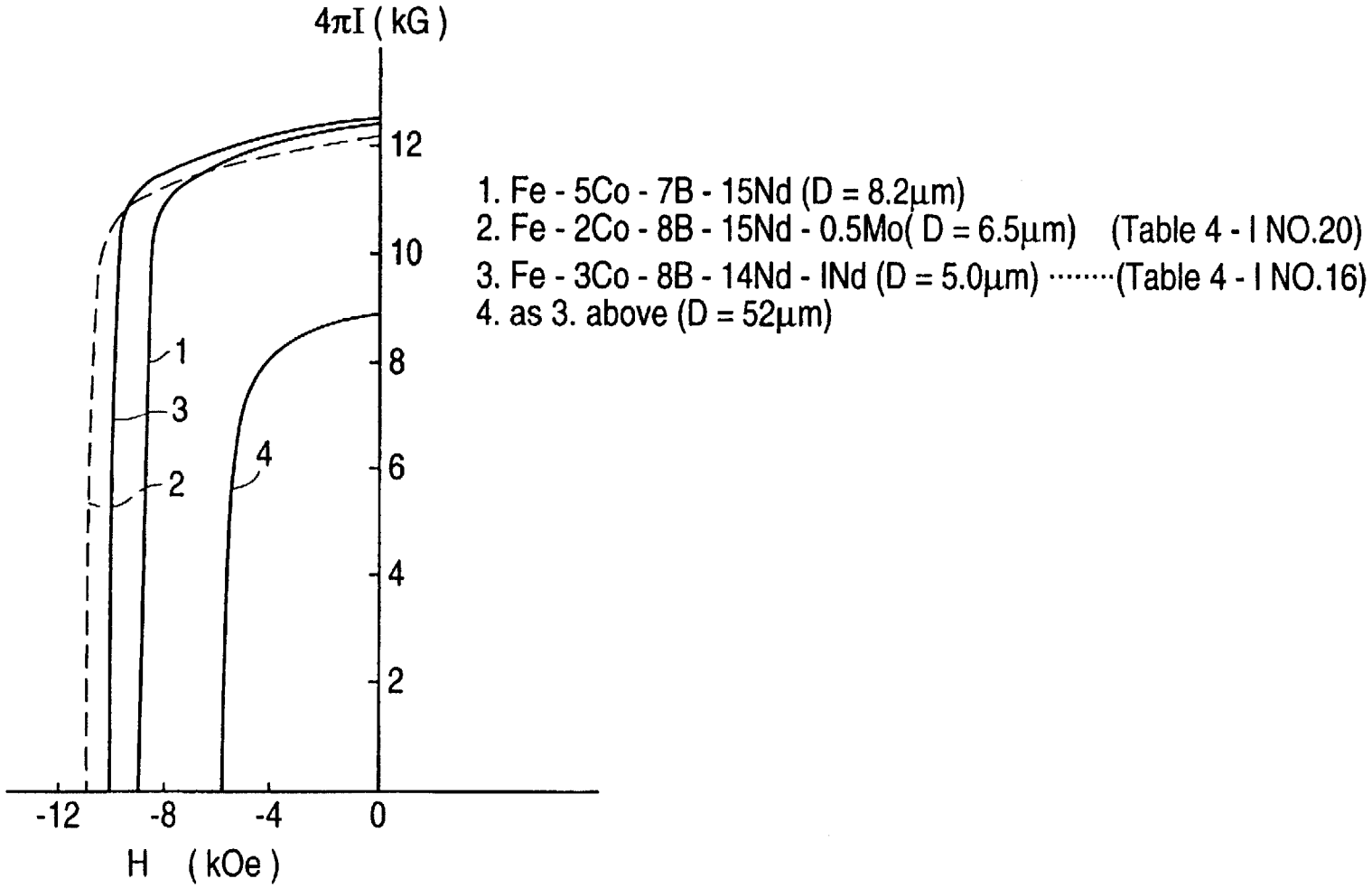
FIG. 11 is a graph showing the demagnetization curves of one embodiment of the present invention.

FIG. 11 shows the demagnetization curves of the typical examples of the invented Fe—Co—B—R—M base magnets and the M-free Fe—Co—B—R base magnets. In this figure, reference numerals 1–3 denote the demagnetization curves of a M-free magnet, a Mo-containing magnet (Table 4-1 No. 20) and a Nb-containing magnet (Table 4-1 No. 16), all of which show the loop squareness useful for permanent magnet materials.

The curve 4 represents ones with a mean crystal grain size D of 52 μm for the same composition as 3.

In Table 5 comparative samples with marks * are shown, wherein *1–*3 are samples departing from the scope of the present invention.

From *4 and *5, it is found that Hc drops to 1 kOe or less if the mean crystal grain size departs from the scope of the present invention.

Samples designated as Nos. 21 and 41 in Tables 4-2 and 4-3 samples were studied in detail in respect of the relationship between their mean crystal grain size D and Hc. The results are illustrated in FIG. 11, from which it is found that Hc peaks when D is approximately in a range of 3–10 μm, decreases steeply, when D is below that range, and drops moderately when D is above that range. Even when the composition varies within the scope as defined in the present invention, the relationship between the average crystal grain size D and Hc is substantially maintained. This indicates that the Fe—Co—B—R—M base magnets are the single domain particle type magnets.

Apart from the foregoing samples, an alloy having the same composition as Sample No. 20 of Table 4-1 was prepared by the (casting) procedure (1) as already stated. However, the thus cast alloy had Hc of less than 1 kOe in spite of its mean crystal grain size being in a range of 20–80 μm.

From the results given in Table 4-1 and FIG. 10, it is evident that, in order for the Fe—Co—B—R—M base magnets to possess Br of about 4 kG of hard ferrite or more and Hc of no less than 1 kOe, the composition comes within the range as defined in the present invention and the mean crystal grain size is about 1–about 100 μm, and that, in order to obtain Hc of no less than 4 kOe, the mean crystal grain size should be in a range of about 1.5–about 50 μm.

Control of the crystal grain size of the sintered compact can be controlled as is the case of the Fe—Co—B—R system.

As mentioned in the foregoing, the invented permanent magnets of the Fe—Co—B—R—M base magnetically anisotropic sintered bodies may contain, in addition to Fe, Co, B, R and M, impurities which are entrained therein in the process of production as is the case for the Fe—Co—B—R system.

CRYSTAL STRUCTURE

It is believed that the magnetic materials and permanent magnets based on the Fe—Co—B—R base alloys according to the present invention can satisfactorily exhibit their own magnetic properties due to the fact that the major phase is formed by the substantially tetragonal crystals of the Fe—B—R type. As already discussed, the Fe—Co—B—R type alloy is a novel alloy in view of its Curie point. As will be discussed hereinafter, it has further been experimentally ascertained that the presence of the substantially tetragonal crystals of the Fe—Co—B—R type contributes to the exhibition of magnetic properties. The Fe—Co—B—R type tetragonal system alloy is unknown in the art, and serves to provide a vital guiding principle for the production of magnetic materials and permanent magnets having high magnetic properties as aimed at in the present invention.

According to the present invention, the desired magnetic properties can be obtained, if the Fe—Co—B—R crystals are of the substantially tetragonal system. In most of the Fe—Co—B—R base compounds, the angles between the axes a, b and c are 90° within the limits of measurement error, and $a_o=b_o\neq c_o$. Thus, these compounds can be referred to as the tetragonal system crystals. The term "substantially tetragonal" encompasses ones that have a slightly deflected angle between a, b and c axes, e.g., within about 1°, or ones that have $\alpha_o$, slightly different from $l_o$, e.g., within about 1%.

To obtain the useful magnetic properties in the present invention, the magnetic materials and permanent magnets of the present invention are required to contain as the major phase an intermetallic compound of the substantially tetragonal system crystal structure. By the term "major phase", it is intended to indicate a phase amounting to 50 vol % or more of the crystal structure, among phases constituting the crystal structure.

The Fe—Co—B—R base permanent magnets having various compositions and prepared by the manner as hereinbelow set forth as well as other various manners were examined with an X-ray diffractometer, X-ray microanalyser (XMA) and optical microscopy.

EXPERIMENTAL PROCEDURES (1) Starting Materials (Purity is given by weight %)

Fe: electrolytic iron 99.9%

B: ferroboron, or B having a purity of 99%

R: 99.7% or higher with impurities being mainly other rare earth elements

Co :electrolytic cobalt having purity of 99.9%

Figure 15A:
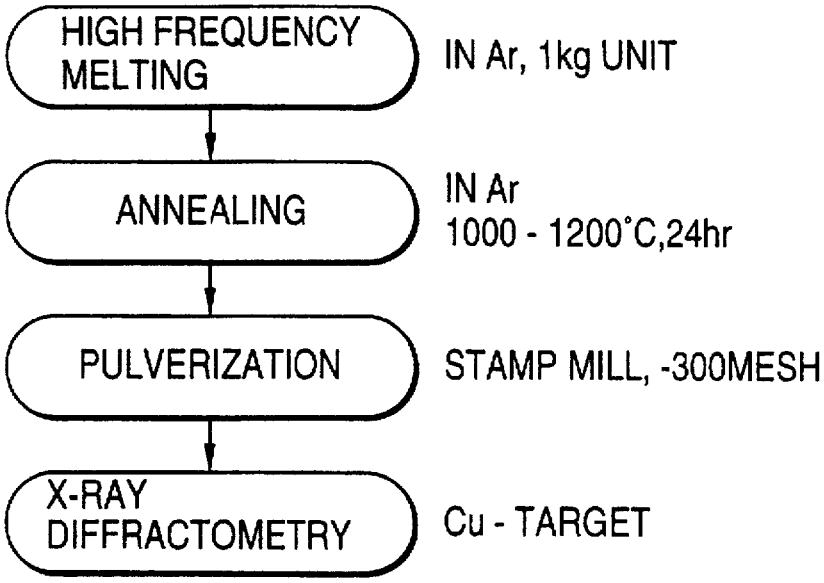
FIG. 15 is a flow chart of the experimental procedures of powder X-ray analysis and demagnetization curve measurements.
Figure 15B:
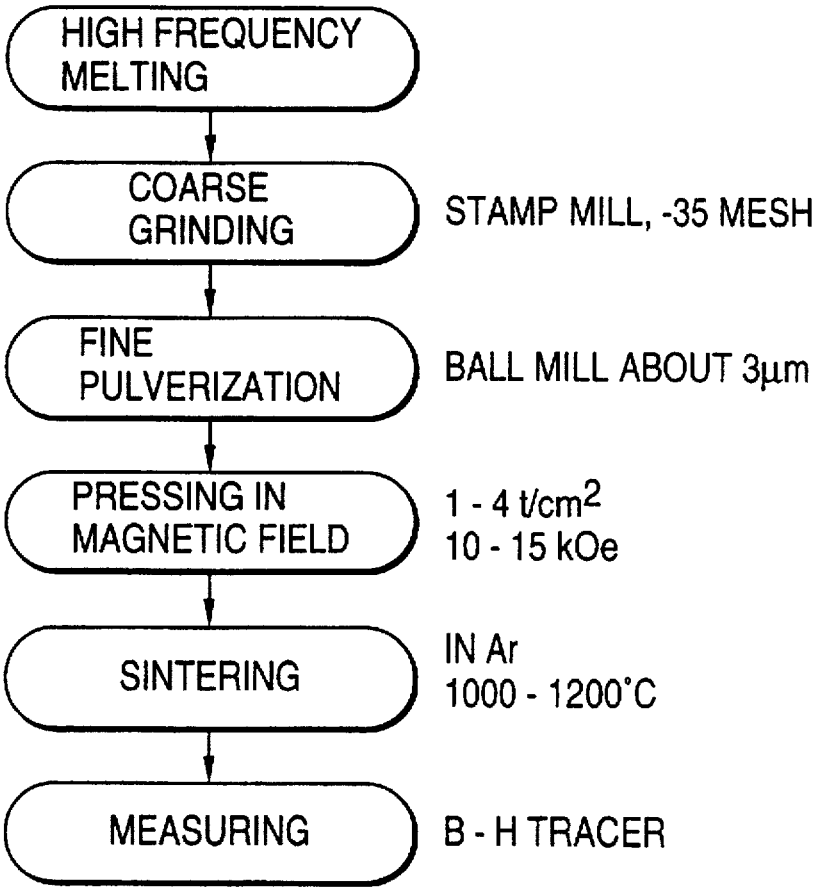
Figure 16:
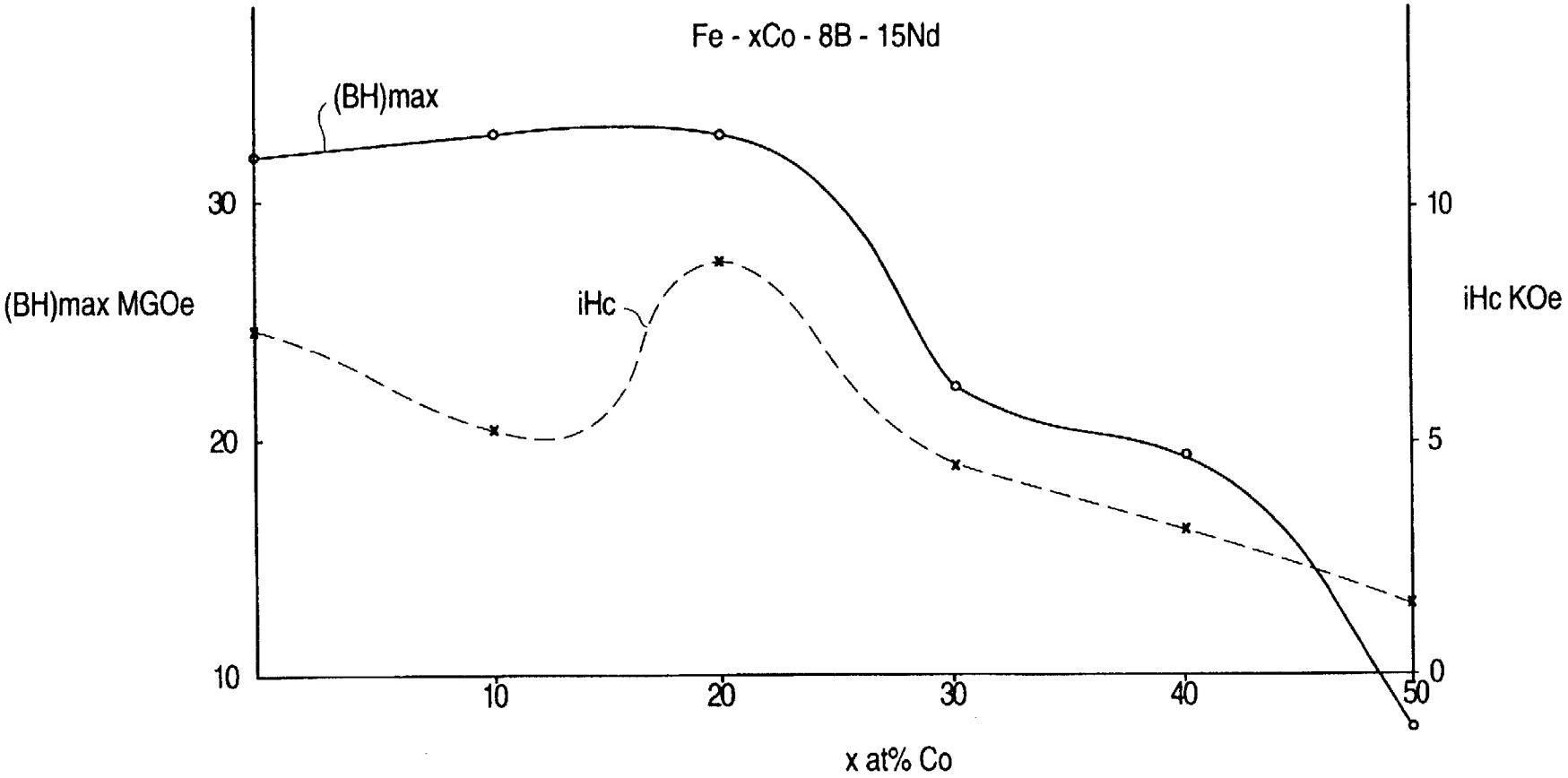

(2) The experimental procedures are shown in FIG. 15.

Figure 14:
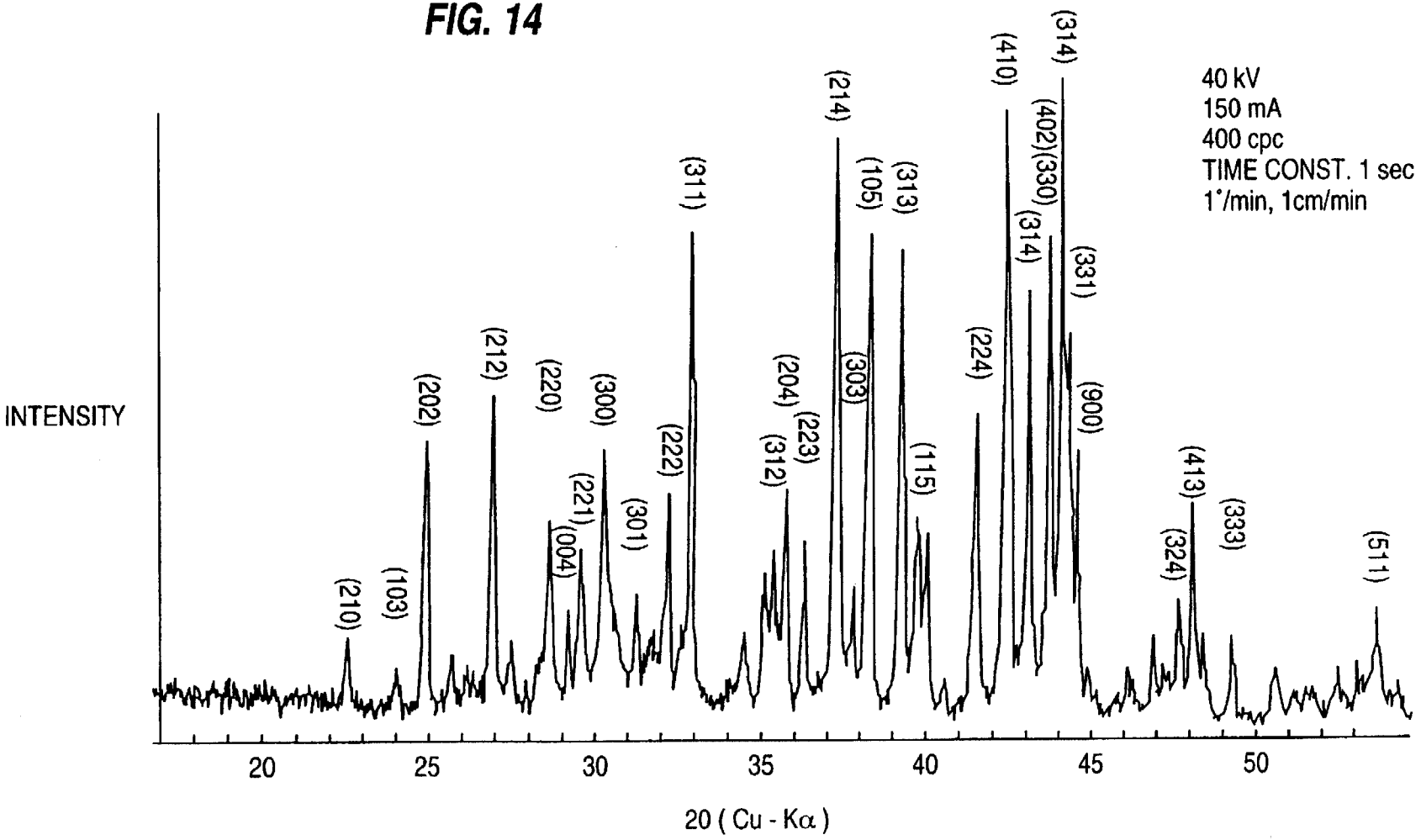
FIG. 14 is an X-ray diffraction pattern of one embodiment of the invention.

The experimental results obtained are illustrated as below:

(1) FIG. 14 illustrates a typical X-ray diffraction pattern of the Fe—Co—B—Nd (Fe—10Co—8B—15Nd in at %) sintered body showing high properties as measured with a powder X-ray diffractometer. This pattern is very complicated, and can not be explained by any R—Fe, Fe—B or R—B type compounds developed yet in the art.

(2) XMA measurement of the sintered body of (1) hereinabove under test has indicated that it comprises three or four phases. The major phase simultaneously contains Fe, Co, B and R, the second phase is a R-concentrated phase having a R content of 70 weight % or higher, and the third phase is an Fe-concentrated phase having an Fe content of 80 weight % or higher. The fourth phase is a phase of oxides.

(3) As a result of analysis of the pattern given in FIG. 14, the sharp peaks included in this pattern may all be explained as the tetragonal crystals of $\alpha_o$=8.80 Å and $c_o$=12.23 Å).

In FIG. 14, indices are given at the respective X-ray peaks. The major phase simultaneously containing Fe, Co, B and R, as confirmed in the XMA measurement, has turned out to exhibit such a structure. This structure is characterized by its extremely large lattice constants. No tetragonal system compounds having such large lattice constants are found in any one of the binary system compounds such as R—Fe, Fe—B and B—R.

(4) Fe—Co—B—R base permanent magnets having various compositions and prepared by the aforesaid manner as well as other various manners were examined with an X-ray diffractometer, XMA and optical microscopy. As a result, the following matters have turned out:

(i) Where a tetragonal system compound having macro unit cells occurs, which contains as the essential components R, Fe, Co and B and has lattice constants $\alpha_o$ of about 9 Å and $\alpha_o$ of about 12 Å, good properties suitable for permanent magnets are obtained. Table 6 shows the lattice constants of tetragonal system compounds which constitute the major phase of typical Fe—Co—B—R type magnets, i.e., occupy 50 vol % or more of the crystal structure.

In the compounds based on the conventional binary system compounds such as R—Fe, Fe—B and B—R it is thought that no tetragonal system compounds having such macro unit cells as mentioned above occur. It is thus presumed that no good permanent magnet properties are achieved by those known compounds.

TABLE 6 crystal structure of various Fe-B-R/Fe-Co-B-R type compounds

| No. | alloy compositions | structure of major phase (system) | lattice constants of major phase $a_o$ (Å) | °o (Å) |
|---|---|---|---|---|
| 1 | Fe-15Pr-8B | tetragonal | 8.84 | 12.30 |
| 2 | Fe-15Nd-8B | " | 8.80 | 12.23 |
| 3 | Fe-15Nd-8B-1Nb | " | 8.82 | 12.25 |
| 4 | Fe-15Nd-8B-1Ti | " | 8.80 | 12.24 |
| 5 | Fe-10Co-15Nd-8B | " | 8.79 | 12.21 |
| 6 | Fe-20Co-15Nd-8B | " | 8.78 | 12.20 |
| 7 | Fe-20Co-15Nd-8B-1V | " | 8.83 | 12.24 |
| 8 | Fe-20Co-15Nd-8B-1Si | " | 8.81 | 12.19 |
| 9 | Fe-6Nd-6B | body-centetred cubic | 2.87 | — |
| 10 | Fe-15Nd-2B | rhombohedral | 8.60* | 12.50* |

N.B.: (*) indicated as hexagonal (ii) Where said tetragonal system compound has a suitable crystal grain size and, besides, nonmagnetic phases occur which contain much R, good magnetic properties suitable for permanent magnets are obtained.

With the permanent magnet materials, the fine particles having a high anisotropy constant are ideally separated individually from one another by nonmagnetic phases, since a high Hc is then obtained. To this end, the presence of 1 vol % or higher of nonmagnetic phases contributes to the high Hc. In order that Hc is no less than 1 kOe, the nonmagnetic phases should se present in a volume ratio between 1 and 45 vol %, preferably between 2 and 10 vol %. The presence of 45% or higher of the nonmagnetic phases is unpreferable. The nonmagnetic phases are mainly comprised of intermetallic compound phases containing much of R, while oxide phases serve partly effectively.

(iii) The aforesaid Fe—Co—B—R type tetragonal system compounds occur in a wide compositional range.

Alloys containing, in addition to the Fe—Co—B—R base components, one or more additional elements M and/or impurities entrained in the process of production can also exhibit good permanent magnet properties, as long as the major phases are comprised of tetragonal system compounds.

As apparent from Table 6 the compounds added with M based on the Fe—B—R system exhibit the tetragonal system as well as the Fe—Co—B—R—M system compounds also does the same. Detailed disclosure regarding other additional elements M as disclosed in the U.S. patent application Ser. No. 510,234 filed on Jul. 1, 1983 is herewith referred to and herein incorporated.

The aforesaid fundamental tetragonal system compounds are sTable lnd provide good permanent magnets, even when they contain up to 1% of H, Li, Na, K, Be, Sr, Ba, Ag, Zn, N, F, Se, Te, Pb, or the like.

As mentioned above, the Fe—Co—B—R type tetragonal system compounds are new ones which have been entirely unknown in the art. It is thus new fact that high properties suitable for permanent magnets are obtained by forming the major phases with these new compounds.

In the field of R—Fe alloys, it has been reported to prepare ribbon magnets by melt-quenching. However, the invented magnets are different from the ribbon magnets in the following several points. That is to say, the ribbon magnets can exhibit permanent magnet properties in a transition stage from the amorphous or metastable crystal phase to the stable crystal state. Reportedly, the ribbon magnets can exhibit high coercive force only if the amorphous state still remains, or otherwise metastable $Fe_3B$ and $R_6Fe_{23}$ are present as the major phases. The invented magnets have no sign of any alloy phase remaining in the amorphous state, and the major phases thereof are not $Fe_3B$ and $R_6Fe_{23}$.

The present invention will now be further explained with reference to the following example.

EXAMPLE

An alloy of 10 at % Co, 8 at % B, 15 at % Nd and the balance Fe was pulverized to prepare powders having an average particle size of 1.1 μm. The powders were coinoacted under a pressure of 2 t/cm$^2$ and in a magnetic field of 12 kOe, and the resultant compact was sintered at 180° C. for 1 hour in argon of 1.5 Torr.

X-ray diffraction has indicated that the major phase of the sintered body is a tetragonal system compound with lattice constants $\alpha_o$=8.79 Å and $c_o$=12.21 Å. As a consequence of XMA and optical microscopy, it has been found that the major phase contains simultaneously Fe, Co, B and Pr, which amount to 90 volume % thereof. Nonmagnetic compound phases having a R content of no less than 80% assumed 4.5% in the overall with the remainder being substantially oxides and pores. The mean crystal grain size was 3.1 μm.

The magnetic properties measured are: Br=12.0 kG, iHc=9.2 kOe, and (BH)max=34 MGOe, and are by far higher than those of the conventional amorphous ribbon magnet.

By measurement, the typical sample of the present invention has also been found to have high mechanical strengths such as bending strength of 25 kg/mm$^2$, compression strength of 75 kg/mm$^2$ and tensile strength of 8 kg/mm$^2$. This sample could effectively be machined, since chipping hardly took place in machining testing.

As is understood from the foregoing, the present invention makes it possible to prepare magnetic materials and sintered anisotropic permanent magnets having high remanence, high coercive force and high energy product with the use of less expensive alloys containing light-rare earth elements, a relatively small amount of Co and based on Fe, and thus present a technical breakthrough.

What is claimed is:

1. A process for producing a crystalline R(Fe,Co)BXAM compound having a stable tetragonal crystal structure having lattice constants of $a_o$ about 8.8 angstroms and $c_o$ about 12 angstroms, in which R is at least one element selected from the group consisting of Nd, Pr, Tb, Dy, Ho, Er, Eu, Sm, Gd, Pm, Tm, Yb, Lu and Y, X is at least one element selected from the group consisting of S, C, P and Cu, A is at least one element selected from the group consisting of H, Li, Na, K, Be, Sr, Ba, Ag, Zn, N, F, Se, Te and Pb, and M is at least one element selected from the group consisting of Ti, Ni, Bi, V, Nb, Ta, Cr, Mo, W, Mn, Al, Sb, Ge, Sn, Zr, Hf and Si, comprising:

preparing a melt of R(Fe,Co)BXAM; and allowing the melt to solidify under a condition such that said fully crystalline R(Fe,Co)BXAM compound having a stable tetragonal crystal structure is formed.

2. The method of claim 1, wherein (Fe,Co) comprises Fe and Co and Co is present in an amount up to 50 atomic % of the sum of Fe and Co.

3. The method of claim 1, wherein (Fe,Co) comprises Fe and Co and Co is present in an amount up to 100 atomic % of the sum of Fe and Co.

4. The method of claim 1, wherein in the group (Fe,Co)Fe is not present in said melt.

5. The method of claim 1, wherein in the group (Fe,Co)Co is not present in said melt.

6. The method of claim 1, wherein X is C.

7. The method of claim 1, wherein A is H.

8. The method of claim 1, wherein X is not present in said melt.

9. The method of claim 1, wherein A is not present in said melt.

10. The method of claim 1, wherein M is not present in said melt.

11. The method of claim 1, wherein A and M are not present in said melt.

12. The method of claim 1, wherein X and A are not present in said melt.

13. The method of claim 1, wherein X and M are present in negligible amounts.

14. The crystalline compound of claim 1, wherein X, A and M are not present in said melt.

15. The method of claim 1, wherein M is selected from the group consisting of V, Si and Al.

16. The method of claim 1, wherein X is C and M is Al.

17. The method of claim 1, wherein X is C, M is Al and R is Nd and/or Dy.

18. The method of claim 1, wherein said fully crystalline R(Fe,Co)BXAM compound is allowed to solidify under a condition so that it has a crystal size of at least 1 μm.

19. The method of claim 1, wherein at least 50 atomic % of R is at least one element selected from the group consisting of Nd and Pr.

20. The method of claim 1, wherein R is Nd.

21. The method of claim 1, wherein R is at least one element selected from the group consisting of Nd, Pr, Tb, Dy and Ho.

22. The method of claim 1, wherein said fully crystalline R(Fe,Co)BXAM compound is allowed to solidify under a condition so that it has magnetic anisotropy.

23. The method of claim 1, wherein said fully crystalline R(Fe,Co)BXAM compound is allowed to solidify under a condition so that it has a Curie temperature of at least 310° C.

24. The method of claim 23, wherein said compound has a Curie temperature higher than a basic compound including no Co having a Curie temperature of at least 310° C.

* * * * *